US006145201A

United States Patent [19]

Andrews

[11] Patent Number: 6,145,201

[45] Date of Patent: Nov. 14, 2000

[54] UNDERARM SHAVING DEVICES

[76] Inventor: Edward A. Andrews, 6835 Beach Rd., Troy, Mich. 48098

[21] Appl. No.: 09/361,433

[22] Filed: Jul. 27, 1999

[51] Int. Cl.[7] ..... B26B 21/06; B26B 21/14; B26B 21/22

[52] U.S. Cl. ..... 30/50; 30/41; 30/34.05; 30/34.2; 30/47

[58] Field of Search ..... 30/34.05, 34.2, 30/41, 47, 50, 51, 57, 49

[56] References Cited

U.S. PATENT DOCUMENTS

| | | | |
|---|---|---|---|
| D. 271,531 | 11/1983 | Byrne . | |
| 1,035,308 | 8/1912 | Boulter . | |
| 1,382,301 | 6/1921 | McCaffrey . | |
| 1,642,338 | 9/1927 | Holtzman . | |
| 1,690,557 | 11/1928 | Smith . | |
| 1,798,447 | 3/1931 | Behrman . | |
| 2,139,680 | 12/1938 | Heinrich . | |
| 2,547,376 | 4/1951 | Crawford . | |
| 2,712,178 | 7/1955 | Marzio . | |
| 3,724,070 | 4/1973 | Dorion, Jr. . | |
| 4,208,791 | 6/1980 | Van Cleve . | |
| 4,270,268 | 6/1981 | Jacobson . | |
| 4,285,124 | 8/1981 | Diakanov . | |
| 4,461,078 | 7/1984 | Carreker . | |
| 5,199,173 | 4/1993 | Hegemann et al. . | |
| 5,208,982 | 5/1993 | Ferruzza, Jr. . | |
| 5,369,885 | 12/1994 | Ferraro | 30/41 |
| 5,557,851 | 9/1996 | Ortiz | 30/50 |
| 5,579,580 | 12/1996 | Althaus et al. . | |
| 5,903,979 | 5/1999 | Oldroyd | 30/41 |

OTHER PUBLICATIONS

Fax assembly regarding dimensions of the razor shown in Figs. 7 and 9 of U.S. Ser.No. 08/236,862, now U.S. Pats. No. 5,369,885. Lisa Peters (Executive Associate to Charles W. Almer), Apr. 2000.

*Primary Examiner*—Hwei-Siu Payer
*Attorney, Agent, or Firm*—Harness, Dickey & Pierce, PLC

[57] ABSTRACT

Manual shaving devices for shaving underarm areas and other small contoured skin surfaces. Each device has a head structure contains one or more razor blade strips between two non-shaving side glide surfaces. In preferred embodiments, the head structure has exposed blade strips about 12 mm to 25 mm (0.5" to 1.0") long, and glide areas each preferably 6 mm to 12 mm long. The blade strips may be straight or curved. The glide areas are preferably rounded with rounded edges, and may smooth or textured. Each device helps facilitate safe shaving of skin surfaces that are soft and pliable by allowing the user to apply, through the glide areas, a non-cutting force to the general area of the skin surface being shaved. This helps alter the skin contour to more closely match that of the sharpened razor blade edges of the device, which are relatively short in length and only bear lightly against the skin to be shaved.

34 Claims, 10 Drawing Sheets

UNDERARM SHAVING DEVICES

FIELD OF THE INVENTION

The present invention relates generally to razor blade shaving devices of the type used for manual shaving of skin surfaces of a human body, and relates more particularly to razor blade shaving devices having a small compact razor head structure with straight or slightly curved razor blades centrally disposed between relatively large-area, side glide surfaces for facilitating shaving of small, contoured skin surfaces, especially the underarms.

BACKGROUND OF THE INVENTION

Certain areas of the human body that are typically shaved include skin surfaces that are either substantially convex or concave. Some of these skin surface areas are among the more delicate areas of the body to shave, especially when the natural body contours result in relatively small cavities of hairy skin, like under the arms. These areas are often characterized by soft, sensitive skin and displaceable tissue beneath the skin to be shaved. Also, the arm pits and certain other curved areas can be difficult to reach comfortably and to see easily, and thus are usually harder to shave. A lower level of tactile sensation in these areas, compared to the face, adds to the shaving difficulties.

Skin areas that have one or more of the foregoing characteristics include the underarm areas, the backs or ankles of the legs, the lower abdomen, etc. These areas are conventionally shaved using manual razor blade devices of the type commonly sold today for all-purpose shaving. Such devices typically employ one or more razor blade strips having a generally straight cutting edge surface profile and a blade length of about 3.8 cm (about 1.5 inches). Modern T-bar safety razors typically have a razor head provided with an elongated front guard, a rear guard of equal length upon which a lubricant strip may be mounted, and very narrow non-shaving side edges. These side edges or ends served as guards in the sense that they cover up the ends of the sharpened razor blades. These front, rear and side guards define a safety boundary and working plane around the razor blade strips. Such straight profile razors usually provide satisfactory performance forthe shaving of relatively flat, large, easy-to-see skin surface areas. But the use of this type of shaving device for shaving skin areas that are smaller, more contoured, more sensitive, softer or harder-to-see, such as the underarm areas, is often more problematic. Also, conventional shaving devices do not appear to have been specifically designed to make such difficult shaving tasks.

Also, in contoured areas, some users of conventional manual shaving devices may tend to apply additional force beyond that which is needed to accomplish the shaving of the desired skin area. Excessive pressure may be applied to the razor, generally perpendicularly against the skin, while the razor blade strips are dragged forward, in an effort to realize improved, closer or faster shaving. Pressing the razor blade head into the skin's surface may help by slightly changing the skin's contour, e.g., by flattening or pushing it somewhat, so that it more closely matches the relatively flat configuration of the available razor blade edge or edges. Unfortunately, such pressing with a conventional manual razor also increases the incidence of undesirable results, namely cuts, nicks and razor burn, i.e., the series of microscopic cuts that occur when one shaves a skin surface too closely. These results, even though usually minor, can in turn can lead to discomfort, especially from when contacted by antiperspirants or clothing. Some inexperienced users of manual shaving devices may thus avoid shaving these sensitive underarm areas due to a fear of these adverse results.

Thus, one shortcoming of conventional manual razor blade shaving devices is that their straight profiles are not well matched to generally contoured skin surfaces, such as the underarm area, legs and arms. Also, their flat configurations and straight edge profiles do not provide a suitable shaving edge or edges for shaving such contoured skin surfaces. Also, they lack means for allowing a user to safely flatten his or her curved skin areas during shaving.

Accordingly, further improvements in the manual shaving systems for shaving small contoured skin surfaces are still needed, especially for shaving sensitive concave regions such as the underarms. There is a need for razor blade structures that do not require the user to press the razor blade strips too forcefully into areas such as the underarm area in order to accomplish the desired closeness or speed in shaving.

It is therefore a first major object of the present invention is to provide a razor blade shaving device having specifically-designed comfortable non-shaving glide surfaces that are operable to contact the skin and apply a significant non-shaving force to a skin surface being shaved to improve the shaving comfort and action. A related object is to provide non-shaving glide surfaces that are positioned and sized to contact and apply non-shaving pressure against the skin in a sufficient amount to alter the skin contour to match more closely that of the shaving portions of the razor blade head, while simultaneously maintaining a more modest force against the razor blade edges shaving the skin. A further related object is to provide side glide surfaces on a razor blade head structure which facilitate conforming the curvature of the skin to be shaved to a flexible razor head structure.

A second major object of the present invention to provide a razor blade shaving device particularly suitable for shaving contoured skin surfaces. It is a further object to provide a razor blade shaving device that is specifically designed to improve the shaving of skin surfaces that are soft and pliable, particularly small concave areas like the underarms. A related object is to provide a manual shaving device for more easily and safely shaving hard-to-reach or hard-to-see curved regions of the skin.

It is a further object of the present invention to provide contoured glide surfaces upon a conventional manual razor to facilitate manipulation of the skin and/or subcutaneous tissue to improve the shaving action of straight-edge razor-sharp blades on difficult-to-shave skin areas. It is a further object to provide non-shaving glide structures which are rounded, balanced and/or symmetrically arranged about the razor blade shaving portions of the razor head to facilitate shaving difficult areas.

It is a further object of the present invention to provide such razor blade shaving devices which include a head structure with non-shaving glide surfaces that the problem is attachable to and compatible with existing handle designs and razor blade platforms. Still another object is to provide moisture-bearing non-shaving surfaces on glide-equipped shaving devices on glide-equipped razor heads to help soften and/or lubricate the hair stubble and/or skin to be shaved. Yet another object to provide such razor blade shaving devices in cartridge form, so that such razor blade structures can be removed and replaced as desired. One more object is to provide improvements which satisfy the foregoing objects in a manner largely compatible with existing designs and manufacturing techniques for conventional razor blade devices.

SUMMARY OF THE INVENTION

To address the aforementioned problems and achieve one or more of the foregoing objects, there is provided, in accordance with a first aspect of the present invention, a manual shaving device comprising a razor head mounted upon and manipulatable by a handle. The razor head has at least one razor-sharp blade and at least one and preferably two non-shaving skin-engaging pressure-applying side surfaces, may be called glides, for altering the skin and/or subcutaneous tissue adjacent to the skin to be shaved. As shown and described in most embodiments, the razor head may have plural razor-sharp blade edges, spaced from one another, and disposed between a pair of adjacent non-shaving skin-engaging side surfaces designed to apply force upon the skin surface being shaved, while maintaining a normal or very modest force of the blade edge or edges against the skin. These non-shaving side glide surfaces are substantially larger, typically at least three or four times larger than the typical non-shaving side guards provided on conventional manual T-bar razors.

The non-shaving pressure-applying side glides may be provided in a variety of arrangements, and preferably are arranged in close proximity to the razor blade or blades. They are most preferably located laterally adjacent to the blade or blades, that is, off to the sides of, rather than in front of or to the rear of, the exposed razor-sharp blade section of the razor head. These non-shaving surfaces are preferably constructed to run smoothly over the skin, which is why I prefer to call them glides, although I sometimes called them pads, wings or glide pads.

These glides or pads are preferably configured to facilitate the shaving of curved skin areas, and to minimize nicks and cuts during shaving, by providing means for applying a non-shaving force against the skin and the tissue underneath for the purpose of causing the skin to be shaved to be flattened. The pads are preferably used in matched pairs, with each pad having a substantially equal surface area to the other pad in the pair. The pads are preferably mirror images of one another, that is symmetrically arranged about the central minor axis of the razor blade head that is perpendicular to the razor-sharp blade edges. Each of the glides in the pair may be configured to have a substantially flat surface, a substantially concave surface, or a substantially convex surface. The glide surfaces may be complex, by being formed from a combination of generally flat and curved areas, which curved areas may be concave or convex. The outer edges of the glides are preferably rounded in the convex sense. This rounding is not only aesthetically pleasing, but also tends to help minimize the bunching of the skin in front of the pads during use of a razor head. In addition, the glide pads may have a curved profile in one direction, such as when viewed from the front, i.e., facing the razor-sharp edge of the razor blade or blades, while being of a different configuration, such as a flat configuration in another direction, such as when viewed in a direction perpendicular to the razor blade edge or edges, i.e., from the side.

The glide pads may also be slightly elevated in whole or in part above the working plane established by the blade edge or edges and associated front and rear guard members. In addition, the glide pads can be spring-loaded either in whole or in part, such as near the exterior edge, near the junction with the razor blade section, or at the mid-section. The glide pads may also optionally be hinged at one end and spring loaded relative to another end.

The present invention further contemplates manual shaving devices having such non-shaving glides integrally formed as part of the underlying razor head base that is attachable to a razor handle, and other versions where the glides are separable from the base portion of the razor head, and are instead connected to the razor blade platform. The present invention also contemplates various combinations of specifically-designed and specifically-adjusted blade profiles and blade lengths and adjacent non-shaving side glide surface structures for contacting and applying non-shaving skin-shaping forces to the skin. All of these glide-equipped manual razor shaving devices represent, to my knowledge, a new shaving device architecture, which can be used and adapted for a new class of wet shaving razor blade devices suitable for manually shaving soft, pliable and/or contoured skin areas, especially small concave contoured skin surfaces.

The advantages associated with these various configurations of the razor blade shaving devices of the present invention include the ability of a user to use the enlarged adjacent non-shaving side surfaces of the razor blade device to reshape a contoured soft skin area, such as by flattening or pushing, to resemble more closely the profile of working regions of razor blades therebetween. Another advantage involves the ability of the glide surfaces to allow more forceful maneuvering of the shaving device with respect to the skin surface being shaved with fewer nicks or scrapes than conventional T-bar razors. This is because the large non-shaving surfaces of the glide pads can safely bring more pressure to bear against the skin than would otherwise be possible to safely accomplish with a conventional T-bar razor with its very narrow sides or ends. Such pressure through the glides of the razor head of the present invention allows the user to reshape the skin area to resemble more closely a flat planar area, rather than a concave or convex area that would otherwise be difficult to shave. Further, the small size of some of my embodiments, with their reduced overall length, combined with the side glides, may allow certain body areas that previously could not be safely shaved, to be shaved with ease.

As will be further explained, yet another advantage of the razors of the present invention is that the razor blade head structure with non-shaving side glides can be configured in cartridge form, to allow easy replacement of worn razor blades. Still another advantage is the ability to construct the razor head structures of the present Invention using equipment very sober to that presently used to construct conventional manual razor blade cartridge structures. One more advantage is that the razor head portions or cartridge structures of the present Invention can be mounted upon many different types of handle structures through either fixed, pivoting, shell bearing, socket or still other connections that are known to those skilled in the art and commonly sold today. The head portion or cartridge structure can also be flexible either in whole or in part. The razor blade portion or razor head structure may also include suitable wire guards for partially shielding the razor blade edges from digging into with the skin. Yet another advantage of the razor blade head structures of the present Invention is that non-shaving mechanical forces can be advantageously applied by the user to the razor head structure as a whole for flattening and/or pushing the skin, while maintaining a much more modest force against the skin surface by the razor blade edge or edges. Thus, the user will be able to more vigorously utilize the shaving devices of the present invention without fear of cuts, nicks or razor burn.

There is one more specific advantage of the embodiment of the present invention specifically designed for shaving the underarm areas, or other concave areas of the body. It constitutes a second major aspect of the present invention, namely a manual razor blade shaving device of shortened effective length relative to a conventional manual razor and suitable for shaving a small, contoured skin surface. According to this aspect of the Invention, hard-to-shaved contoured skin areas are safely conformed, by virtue of the large non-shaving force-applying surfaces call the glides or pads, to the profile of the razor-sharp blade edges. This shortened razor blade device includes a head structure suitable for attachment to a handle portion. The head structure includes a base portion, a blade structure that is preferably removably attachable to the base portion, and that includes at least one razor blade suitable for shaving and having an edge profile, and at least a pair of relatively large force-applying surfaces located adjacent to the blade structure and operable to transmit non-shaving force applied to the head structure to the skin surface in an amount sufficient for adjusting the contour of the skin surface to more closely match the profile of the razor head structure while controlling the application of force from the razor head structure upon the skin surface. Preferably the razor blade edge is of shortened length, so that only a relatively short section of contoured skin need be straightened at any one time to match the straight-edge profile of the razor blade.

The shaving devices of the present invention with large-area side glides as described above, may include either a single razor blade strip, twin razor blade strips, or three razor blade strips, as in conventional manual razors. Preferably, for shaving smaller contoured skin areas, such as the underarms, short-length razor blade strips are employed in the devices of the present invention. The exposed lengths of these blade strips are preferably between about ⅓ to about ⅔ the length of the conventional 35 mm (about 1.5 inch) razor blade strips. Additionally, this shortened exposed razor blade length may be provided in a straight configuration or may be pre-curved in either a concave or convex configuration, as desired. This shortened length of exposed razor blade edge (or edges) may be accomplished in several ways, including constructing a shortened razor blade assembly as an insertable cartridge fitting within a structure or upon a base portion of greater overall length. Additionally, the shortened exposed razor blade edge length may be accomplished through the use of specially-designed covers disposed upon the end portions of a razor blade structure of conventional blade length. These embodiments may used in both fixed and floating blade arrangements.

Other objects, variations, features, operating principles, and advantages of the manual razor blade shaving devices of the present invention with side glides will become apparent upon studying the various Figures in the drawings and reading the following detailed description and subjoined claims.

BRIEF DESCRIPTION OF THE DRAWINGS

In the drawings, where the same reference numerals refer to like items or features in the different views:

FIGS. 4 through 8 illustrate, in side perspective views, third through ninth alternative embodiments of the T-bar razors of the present invention in schematic form of some of the available relative configurations of razor head structures, extension portions and base portions attached to handle portions by various connection arrangements, wherein:

FIG. 4 shows a third embodiment having a razor head structure of a generally planar configuration with the generally flat extension portions and glide surfaces, disposed upon a planar base portion in a fixed connection arrangement to a handle portion;

FIG. 5 shows a fourth embodiment having a generally planar razor head structure between upwardly or concavely curved extension portions and glide surfaces disposed upon a base portion with corresponding planar and concavely curved end extension sections, mounted upon a handle portion through a conventional pivoting connection arrangement;

FIG. 6 shows a fifth embodiment having a generally planar razor head structure and downwardly or convexly curved extension portions and glide surfaces, disposed upon a base portion having corresponding planar and convexly curved sections, attached to a handle portion through a conventional shell bearing connection arrangement;

FIG. 8 shows an eighth embodiment having a convexly curved configurations for a razor head structure, extension portions and glide surfaces, disposed upon a corresponding convexly curved base portion, attached to a handle portion.

FIGS. 19 through 22 illustrate alternative embodiments for the razor cartridge structure of the type removably attachable to the razor head base portion in FIGS. 10, 13, 15 or 17, wherein:

FIG. 19 shows a double-bladed cartridge structure with an internal carriage movable along a pin and slot arrangement for allowing limited front-to-rear movement of the razor blades within the razor head structure;

FIG. 20 is a perspective view of another double-bladed razor cartridge structure, having multiple guard members disposed across the razor blade edges;

FIG. 21 is a perspective view of another double-bladed razor cartridge structure, having permanently pre-curved blades in a concave configuration; and FIG. 22 is a perspective view of another double-bladed cartridge structure, having flexible razor blades housed between notched flexible front and rear guards to provide flexibility for the razor head structure as a whole.

FIGS. 23 through 25 illustrate a fourteenth embodiment of the shaving head structure according to the present invention, having a razor head structure and hinged, spring-loaded extension portions normally elevated in part above the razor head structure surface, wherein:

FIG. 23 shows a top view of this embodiment of head structure, with the spring members shown in phantom;

FIG. 24 is a front view of the head structure shown in FIG. 23, with the spring members maintaining the extension portions in a partially elevated condition above the razor head structure surface; and FIG. 25 is a partial cross-sectional front view showing the head structure of FIGS. 23 and 24 having the extension portions compressed to a closed condition from the application of force thereupon.

DETAILED DESCRIPTION OF THE PREFERRED EMBODIMENTS

While the present invention is described in connection with particular examples thereof, the scope of the invention is not to be so limited. Rather, those skilled in the art should appreciate that the teachings herein can be used in a wider variety of manual shaving devices. For example, various combinations of individual features, configurations and materials disclosed herein in one embodiment are capable of substitution in various other embodiments set forth herein. Thus, it should be appreciated that this description sets forth only a several exemplary combinations available as part of this invention, as the following discussion, should help make clear.

Figure 1:
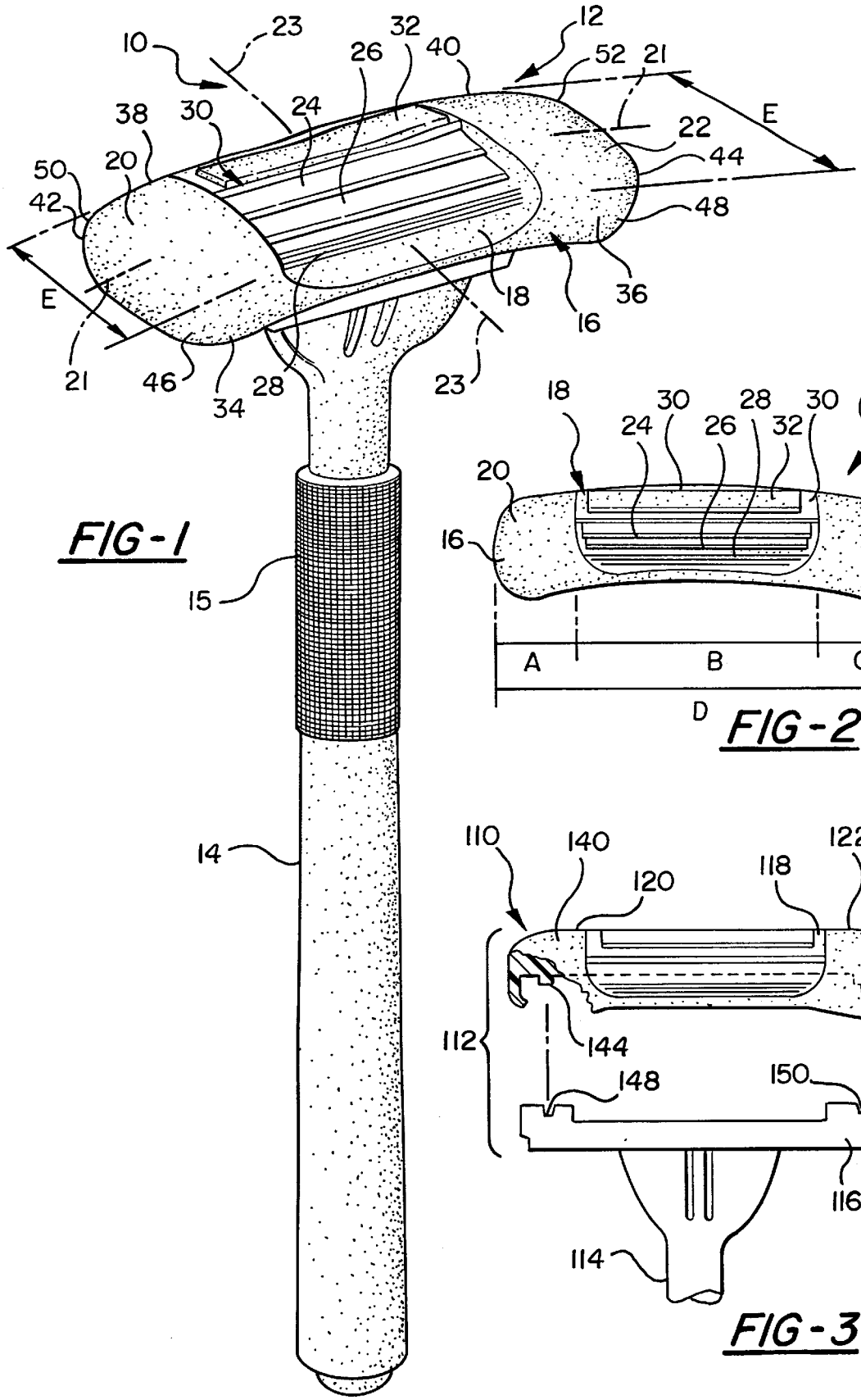
FIG. 1 illustrates a first embodiment of the T-bar razor blade shaving device of the present invention, in perspective view, as having a generally cylindrical handle and a razor head arranged in T-bar fashion, with the shaving head having a centrally located razor blade structure located between a pair of large non-shaving force-applying side surfaces, called glides or pads.

FIG. 1 shows razor blade shaving device 10 of the present invention designed specifically for the shaving of curved or contoured skin surfaces, especially those of small surface areas, such as the underarms. Device 10 includes an elongated razor head structure 12 mounted upon elongated handle portion 14 in a conventional T-bar arrangement. Handle 14 is preferably like the elongated handles forming a part of many manual razor blade devices commonly sold today, and may be generally cylindrical, generally rectangular, generally oval, or any other conventional or suitable shape. Handle 14 is typically made of plastic or metal material or a combination thereof. It may include suitable grip-enhancing, tactile-sensation-enhancing surfaces, such as knurled surface 15. Razor head 12 may be attached to handle portion 14 through any conventional or suitable attachment means, including but not limited to a fixed attachment, a sliding rail attachment, a pivoting attachment, a shell bearing attachment, or a socket attachment, or it may be integrally molded in a one-piece construction with base portion 16 on the bottom side of razor head structure 12. In general, the razor heads of the present invention preferably have a central longitudinal axis which is perpendicular to the central longitudinal axis of the elongated handle to which it is attached. If desired, the working face of the razor head may be tilted forward slightly or substantially, as is often done with modern T-bar razor devices.

Razor head structure 12 preferably includes elongated head base portion 16 and elongated razor blade structure 18. Base 16, forms the underlying structure or frame for the mounting, attachment and/or integral formation of many of the head structure components described in multiple variations herein, and is longer than structure 18 in this embodiment. Base 16 is typically made from plastic, although metal or other materials or combinations of material are also suitable. Base portion 16 as shown includes an overall smooth exposed surface having a convex contour that is suitable for comfortable sliding contact with concave skin surface areas. Base portion 16 may be configured or contoured in any desired manner that is suitable for the shaving of any particular area of skin. Head base 16 is preferably configured and contoured so that a non-shaving force applied to the razor head structure by the user through handle 14 results in a transfer of a suitable amount of mechanical force through to the glides or pads so that the skin surface is temporarily re-configured. By such flattening or pushing, the skin more closely matches the configuration or contour of the working face of the razor blade structure, specifically the exposed razor blade edge section. This allows the exposed razor-sharp blade edge or edges to shave the protruding hair stubble safely and closely.

Razor blade structure 18 is centrally mounted upon head base portion 16, and is preferably constructed as a removable, replaceable generally rectangular elongated cartridge, containing one or more razor blades in an arrangement suitable for manual shaving of a skin surface. Structure 18 is preferably a razor blade cartridge assembly similar to those commonly found in conventional manual razors. It may include a platform, a pair of spaced substantially parallel elongated razor blade strips, each having a razor-sharp edge, a conventional spacer member to keep the razor blade strips apart, and an elongated cap member, preferably with plastic pins projecting through and retaining the blade strips in position. Structure 18, especially when set up for shaving small concave areas, such as the underarms, is preferably of a much shorter length, in terms of exposed elongated razor-sharp blade edges, than is a conventional T-bar razor head which typically is about 38 mm (about 1.5 inches) long. For underarm shaving, the exposed razor-sharp blade edges of structure 18 are preferably about 12 mm (about 0.5 inch) to about 25 mm (about 1 inch) long, with exposed razor blade edge lengths of about 20 mm (about 0.80 inch) or less being presently preferred. The area of each non-shaving surface is preferably at least 50 square mm, and more preferably 60 square mm, 80 square mm or 100 square mm. The larger the area, the more readily the soft pliable contoured skin to be shaved can be pushed inwardly to alter the profile of the skin adjacent the non-shaving surfaces to resemble or match more closely the nominal profile of the razor-sharp blade edge. The word "nominal" is applicable when the razor blade structure 18 is constructed to be flexible, like the commercially available Schick Tracer razors with their flexible platforms. Structure 18 may be rigid, or may be of a pre-curved configuration, and may include a movable razor blade strip arrangement, such as is found in the commercially available Gillette Sensor and Mach3 razors.

In FIG. 1, head base portion 16 of shaving device 10, is shown with a pair of large non-shaving skin-engaging pads called glide surfaces 20 and 22 symmetrically arranged about razor-sharp blade razor structure 18. These glides are specifically designed, sized and arranged in opposed relation on either side of section 18, in order to be able to apply considerable non-shaving force to the skin immediately adjacent to and on either side of an area of skin currently being shaved. In this manner, head 12 as a whole is able to temporarily re-configure the shape of the skin being shaved so as to maintain a more normal, modest force of the blade surfaces within the razor head structure 18 against the skin surface. In other words these non-shaving pads or glide surfaces are each made large enough, in terms of surface area, to be used for the application of sufficient force to the skin's surface to change the profile of a normally contoured skin surface to be substantially closer to that of the straight razor-sharp blade edge, e.g., by flattening or pushing the skin surface in contact with the glide surfaces on both sides of the exposed razor blade edges.

In FIG. 1, first and second glide surfaces 20 and 22 are formed as integral portions of head base portion 16. (These glide surfaces may also be in the form of removable, replaceable attachments to base portion 16, as explained in certain embodiments below.) Glide surfaces or pads 20 and 22 are designed to move over the skin surface while applying sufficient force for pushing, spreading or otherwise deforming the skin. Pads 20 and 22 may be configured to have to be a generally rounded rectangular shape as shown, a substantially flat, concave or convex surface, or a combination of the above upon a single surface. Non-shaving surfaces 20 and 22 are preferably symmetrically or almost symmetrically arranged about the central longitudinal axis 21 of razor head, in terms of overall area when viewed from above, and are preferably fully symmetrical and mirror images of one another about the central transverse major axis 23 of the elongated razor blade structure 18.

Figure 2:
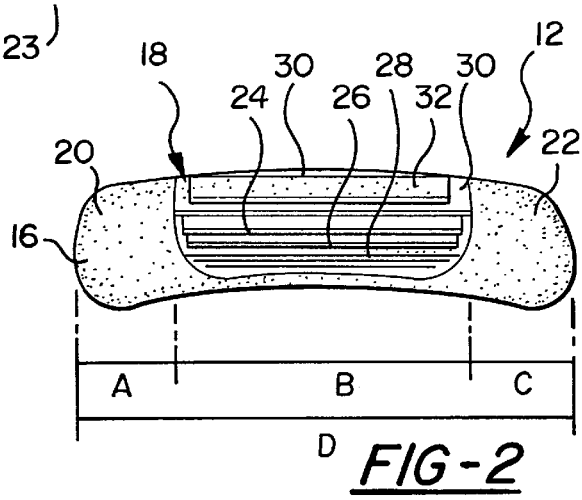
FIG. 2 is a front view of a razor head structure forming part of the razor blade shaving device of FIG. 1.

As shown in FIGS. 1 and 2, for example, glide surfaces 20 and 22 may be gently curved when viewed from both front and side perspectives of head 18. This curved and rounded configuration provides generally non-binding, snag-free contact and smooth travel over a sensitive skin surface below or near the area being shaved, such as the underarms. The profiles for the glide surfaces may be altered as desired. For instance, glide surfaces 20 and 22 may have a curved profile in one direction, such as when viewed in the direction of the razor blade or blades, while being of a different configuration, such as a flat configuration in another direction, such as when viewed in a direction perpendicular to the razor blade edge or edges. Such alteration may be desirable with skin that is more firm or taut, such as the generally flat areas of skin in the lower abdomen area. It should be appreciated, with respect to all of the embodiments herein that the shapes for the glide surfaces may be altered from one or both perspectives, from that shown. The variations for the shapes of these glide surfaces that are shown and described in the various following embodiments help illustrate this principle.

In FIG. 1, the length of each glide surface 20 and 22 of device 10, as measured along longitudinal axis 21 of structure 18, is on the order of about 20 percent to about 100 percent of the length of exposed sharpened blade edge length. Preferably, glide surfaces 20 and 22 each have a length of about 30 percent to about 75 percent of length of the exposed sharpened blade edge. Surfaces 20 and 22 may also be elevated in whole or in part above the working plane established by the conventional front and rear guards of structure 18. In addition, glide surfaces 20 and 22 may be spring-loaded either in whole or in part, such as near the exterior edge, near the junction with the razor blade section, or at the mid-section. Glide surfaces 20 and 22 may also optionally be hinged at one end and spring loaded relative to another end, as shown in later embodiments.

Suitable materials for glide surfaces 20 and 22 are non-sticking plastic materials, such as polyethylene terephthalate (PETE), light or medium density polyethylene or polypropylene, polytetrafluoroethylene, butyl rubber or smooth stamped or cast metal materials. Additionally, the glide surfaces may be constructed in a layered configuration, and/or provided with a suitable coating, texture or lubricant which enhances their functions. If desired, the lubricant layer may largely cover the glide surfaces. Also, the glide surfaces may be covered with a water-absorbing smooth foam or porous rubber layer if desired, which can optionally be imbued with emollients or skin conditioners.

FIG. 2 has been marked with reference letters to help discuss the relative sizes of glide surfaces relative to the razor head structure. Preferably, the overall lengths A and C of first and second glide surfaces 20 and 22 are equal. For underarm shaving applications, the lengths A and C measured outwardly of the exposed razor-sharp edge of the blade strips are each at least about 5 mm, and preferably about 8 mm (about 5/16 inch) to about 25 mm (about 1 inch), with about a range of about 10 mm (about 0.4 inch) to about 20 mm (about 0.8 inch) being most preferred. The length B of razor blade structure 18 normally is in the range of about 10 mm (about 0.4 inch) to about 30 mm (about 1.2 inch), with the range of about 13 mm (about ½ inch) to about 25 mm (about 1 inch) being preferred. Width E is preferably in the range of about 8 mm (about 5/16 inch) to about 20 mm (about 8/10 inch), with the range of about 10 mm (about 4/10 inch) to about 15 mm (6/10 inch) being preferred.

One preferred size for razor head 12 when used for an underarm shaving device for an average size woman (about 150 cm to 175 cm in height), is in the range of:

A=8 to 10 mm; B=16 to 20 mm; C=8 to 10 mm; D=32 to 40 mm; E=8 to 10 mm.

For an underarm shaving device of the dimensions, described, suitable rounding radii for front edge sections 34 and 36, rear edge sections 38 and 40, and outer edge sections 42 and 44 are in the range of about: 2 mm to 4 mm. A suitable rounding radius for the outer front corners 46 and 48 and outer rear corners 50 and 52 (which corners are most clearly visible when face (or top) of razor head 12 is viewed from directly above, in the range of about: 2.5 mm to 5 mm.

Lengths A, B, C and D and width E may be varied as desired for achieving optimum shaving performance of a given area of the body. For example, for shaving larger areas than the underarms, such areas of the torso, lower abdomen or legs, the preferred range for lengths A and C is about to 12 mm (about ½ inch) to about 22 mm (about 7/8 inch), while the length of razor blade structure 18 may be varied from about 20 mm (about 0.8 inch) to about 35 mm (about to 1.4 inch) or larger. Similarly, the width E may also be varied and is preferably larger, from about 9.5 mm (about 3/8 inch) to about 23 mm (about 0.9 inch), with 11 mm (about 7/16 inch) to about 19 mm (about 3/4 inch) being preferred. Typically, the width E will be larger than or about equal to the individual lengths A and C. In those situations where the non-shaving surfaces are particularly long, the width E may be slightly shorter than the individual lengths A and C.

In most applications, preferred lengths A and C for each of glide surfaces 20 and 22 are between about one-quarter and about three-quarters of the length B of razor head structure 18, with the preferred dimensions for lengths A and C being about one-third to about two-thirds of the length B being preferred. In some applications, it may be desirable to make lengths A, B and C all substantially equal. In most applications, the preferred width E will be greater than or equal to the individual lengths A and C. However, in situations where the individual lengths A and C are about equal to length B, it may be desirable to have width E made less than individual lengths A and C, perhaps as much as about one-half of the individual lengths A and C for razor head structures which are substantially longer than they are wide.

One important aspect of the glide surfaces 20 and 22 is the total area which each glide surface presents. The ability of the non-shaving surfaces to apply sufficient force to soft mushy skin successfully cause the skin to be shaved to closely resemble the profile of the sharp razor-sharp edge of the exposed blade section depends in part upon these non-shaving surfaces to be large enough to engage sufficient skin and subcutaneous tissue thereunder so as to substantially flatten or at least draw relatively taut the adjacent area of skin to be shaved between the two glide surfaces. In addition, the non-shaving surfaces 20 and 22 must engage enough skin area to avoid forming point-like or line-like indentations or depressions in the skin that may leave temporary marks in the surface of the skin. Further, the edge portions of the non-shaving surfaces 20 and 22 which engage the skin must be sufficiently rounded so as to avoid creases, indentations or depressions that leave any mark, even of a temporary nature, on the skin that users of the shaving devices of the present invention may find objectionable. Leaving temporary marks on the skin is much easier to do with skin that is not regularly used for load bearing purposes, and the problem increases as the area of significant contact pressure becomes smaller. Hence it is desirable to provide sufficient surface area and rounded edge portions for the devices of the present invention, especially for those devices that are to be used with skin that normally is rarely if ever pressed against objects that might toughen it up. Examples of such areas of the skin of adults include the skin of the underarm areas and the lower abdomen. In addition, some individuals who need to shave such areas may have skin that is unusually susceptible to hematomas upon the application of more than normal pressure levels. Again, providing larger areas for non-shaving surfaces 20 and 22 and rounded edge portions is desirable to prevent formation of such bruised areas on sensitive individuals.

The ratio of the face area of the one of the non-shaving skin surfaces 20 or 22 to the overall face area of the razor blade structure 18 provides one way to quantify this desirable attribute of the razor head structures of the present invention. Preferably, each of the non-shaving skin surfaces 20 and 22 is generally rectangular with rounded edge sections and rounded outer corners, and has a face area that is at least about one-quarter of the total face area of razor blade structure 18, that is, a 1:4 ratio of face areas. By the term "face area" I mean the area of the surface or structure in question which is visible when viewing the razor head 12 at a distance from directly above, i.e., in a plan or top view. In more preferred embodiments, this ratio of face areas noted above is at least 1:3 or less, and may be as high as 1:2 or even 1:1.

The rounding of the edge sections and portions may be very generous, as shown in the first embodiment. Preferably, the average radius of curvature or rounding ranges from a minimum of at least 1 mm (about 0.04 inch) to about 10 mm (about 0.4 inch), with rounding radii of at least 2 mm (about 1/12 inch) to about 8 mm (about 5/16 inch) being more preferred. Preferably, the smaller average rounding radii forthe edge portions are used in conjunction with the smaller values of lengths A and C and width E, and the larger average rounding radii are for the edge portions used in conjunction with larger values of the lengths A and C and width E. It should be appreciated, as shown in FIG. 1 that the rounding made in fact be a complex curvature designed to provide generally flat central areas to the non-shaving services 20 and 22, as shown in FIG. 1. In the FIG. 1 embodiment, the average radius of curvature of the rounded front edge portion and rounded rear edge portion of the skin-engaging non-shaving surfaces 20 and 22, when viewed at a distance from either end along the longitudinal axis of the head structure, are at least about 2.5 mm (about 0.1 inch), with about 4 mm (about 5/32 inch) or more being preferred. Similarly, surfaces 20 and 22 have rounded outer corners, when viewed from directly above at a distance, of at least about 2 mm radius, and more preferably about at least 3 mm radius (about ⅛ inch) or more being preferred.

As shown in FIG. 2, razor head structure 18 includes first and second flat ribbon-like razor blade strips 24 and 26 spaced from and parallel to one another. Blades 24 and 26 preferably are provided with conventional spacing and acute angles relative to the working plane of the head such as found in conventional dual-blade razor heads of T-bar razors. Alternatively, structure 18 may have a single razor blade, or may have more than two razor blades, if desired. The razor blade or blades of razor head structure 18, and head 18 itself, may also take on any suitable configuration, such as: straight razor blade strips mounted in a fixed location to the head; spring-loaded movable razor blade strips, like the Gillette Sensor razor blade strips; a flexible head and blade configuration like the Schick Tracer razor head; a movable blade-carrying carriage configuration; or any other suitable configuration. Blade strips 24 and 26 each have razor-sharp blade edges which project into a working plane defined by exposed generally flat surfaces of elongated front guard 28 and elongated rear guard 30. If desired, the razor-sharp edge of front blade 26 may project ever so slightly farther into the working plane than the razor-sharp edge of rear blade 24, in order to provide for enhanced shaving action, in a manner known to those skilled in the art. Optional lubricant strip 32 is disposed upon and forms part of the surface of rear guard member 30 for providing lubrication to the skin surface during shaving.

Figure 3:
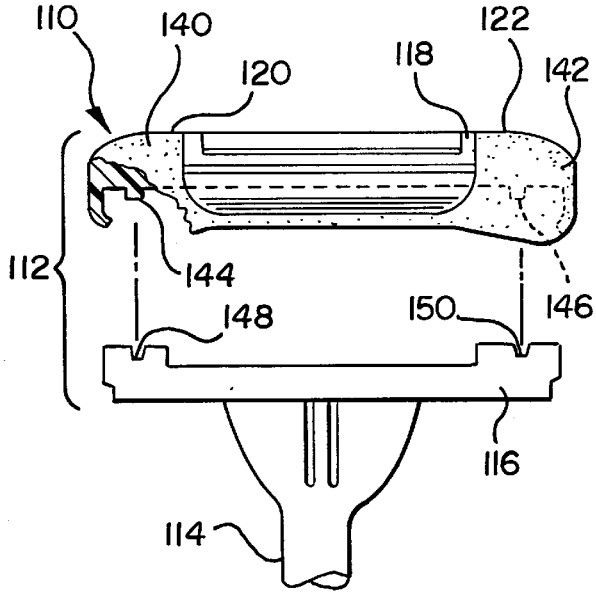
FIG. 3 is a second embodiment of the T-bar razor blade shaving device of the present invention, showing, in a partially exploded front view, a razor blade structure with attached lateral extension portions, which is detachably connectable to a base portion and handle.

FIG. 3 shows device 110, another embodiment of razor blade shaving device of the present invention, which includes head structure 112 and handle portion 114. In this embodiment, head base portion 116 does not include the glide surfaces to the razor head structure previously described. Rather, razor head structure 118 includes side extension portions 140 and 142, which respectively include glide surfaces 120 and 122. Structure 118 (including portions 140 and 142) is attached to base portion 116 using pins, such as pins 144 and 146, located along the lower surfaces of extension portions 140 and 142. These pins are sized to be engaged and held in place within recesses 148 and 150 formed in base portion 116, such as by a press-fit or interlocking snap arrangement. Extension portions 140 and 142 may also be attached to base portion 116 by any other suitable means.

FIGS. 4 through 8 are schematic diagrams illustrating, in general form, different configurations or shapes for the various components of the head structures of the present invention. The adjustments, namely the addition of curvatures or contours, in the form of various components shown in these Figures may provide enhanced performance over curved skin surfaces to be shaved. Although the various components are shown in a modular, attachable form for ease of illustration, any one or more of these components may be combined in an integral form or otherwise combined to achieve the goals of the present invention.

Figure 4:
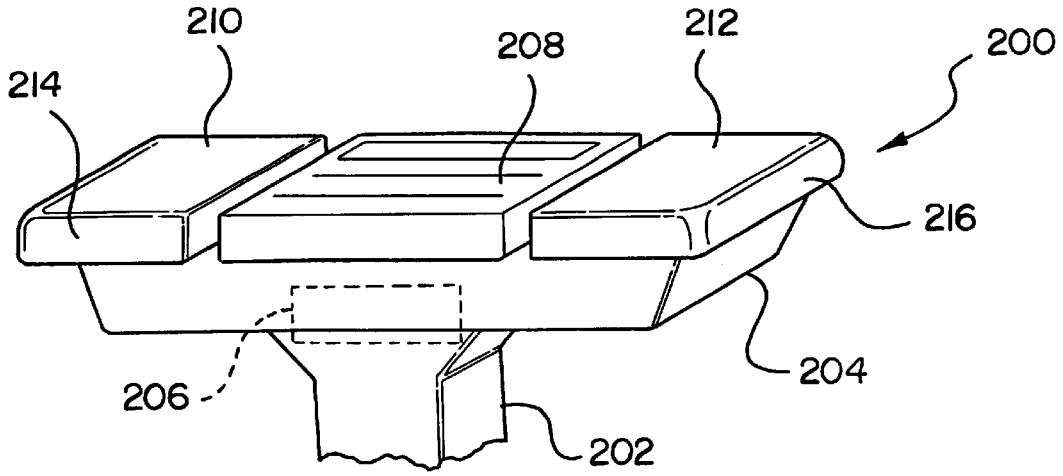

FIG. 4 shows handle 202 attached to elongated head structure 200, which includes base portion 204 of a generally planar configuration. Base 204 is attached to handle 202 by fixed, rigid connection portion 206. Razor head structure 208, also of a generally planar configuration, is disposed upon base portion 204 and is flanked at its lateral edges by first and second extension portions 214 and 216 which include glide surfaces 210 and 212, respectively. Portions 214 and 216 are also of a generally planar arrangement, such that head structure 200 is of a generally planar arrangement as a whole. The extension portions may be generally rounded at their edges, as shown, for enhancing snag-free contact and smooth movement relative to the skin.

Figure 5:
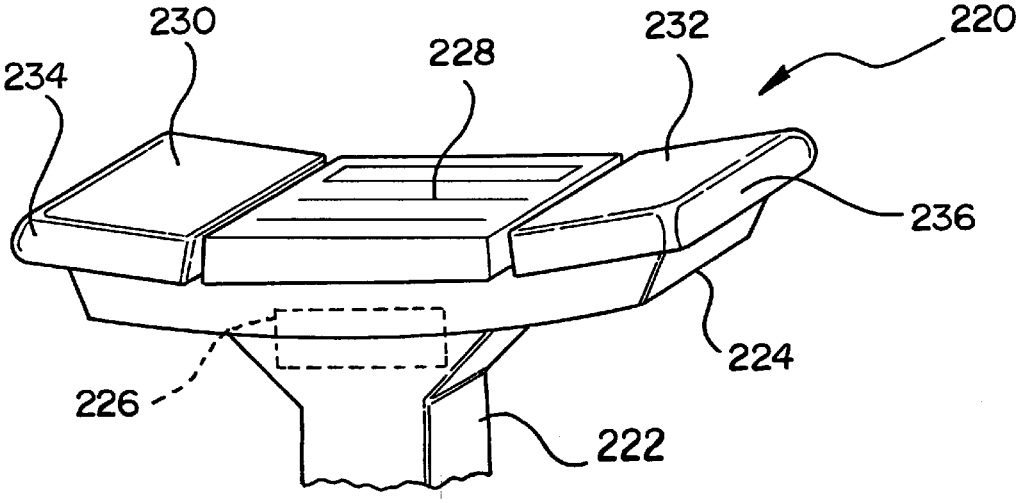

FIG. 5 shows head structure 220 mounted upon handle portion 222 by base portion 224, connected through a conventional pivoting connection portion 226. Base portion 224 has a generally planar central section and upwardly or concavely curved end portions. The configuration of base portion 224 is suitable for accommodating the attachment of generally planar razor head structure 228 and concavely curved extension portions 234 and 236 which respectively include upwardly or concavely curved glide surfaces 230 and 232.

Figure 6:
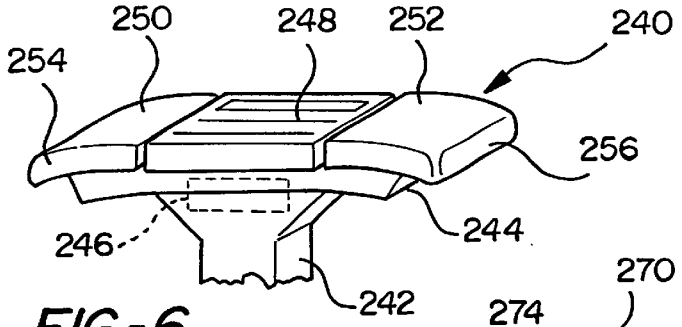

FIG. 6 shows another embodiment having head structure 240 attached to handle portion 242 through conventional shell bearing connection portion 246. Head 240 has base portion 244 with a generally planar central section and generally downwardly or convexly curved end regions. FIG. 6 shows a generally planar razor head structure 248, which is flanked by generally downwardly or convexly curved extension portions 254 and 256, respectively having downwardly or convexly curved glide surfaces 250 and 252.

Figure 7A:
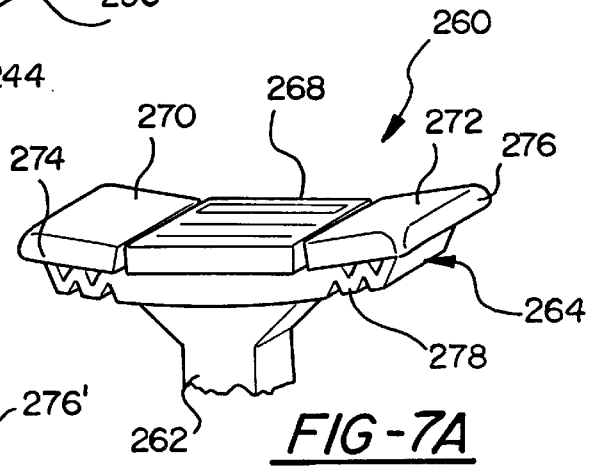
FIG. 7A shows a sixth embodiment having an upwardly or concavely curved configuration for a razor head structure and glide surfaces mounted upon a corresponding concavely curved base portion that has flexible end portions supporting the glide surfaces, fixedly attached to a handle portion.

FIG. 7A shows razor head structure 260 of the present invention, which is shaped in its entirety in an upwardly or concavely curved configuration. Its head base portion 264 is shown attached to handle portion 262. The configuration of base 264 is suitable for the attachment of curved razor head structure 268, and curved extension portions 274 and 276, all of which are arranged in an upwardly or concavely curved configuration. This configuration complements glide surfaces 270 and 272 which may also be upwardly oriented or curved. Base portion 264 includes flexible end support portions 278 for providing base portion 264 with the ability to flex upon the application of force to extension portions 274 and/or 276 through contact with the skin. This concavely curved arrangement for the skin-engaging force-applying glide surfaces is beneficial because it helps ensure that, in most instances, the non-shaving glides will engage and begin to re-shape the skin to be shaved before the razor blade edges contact the skin to be shaved.

Figure 7B:
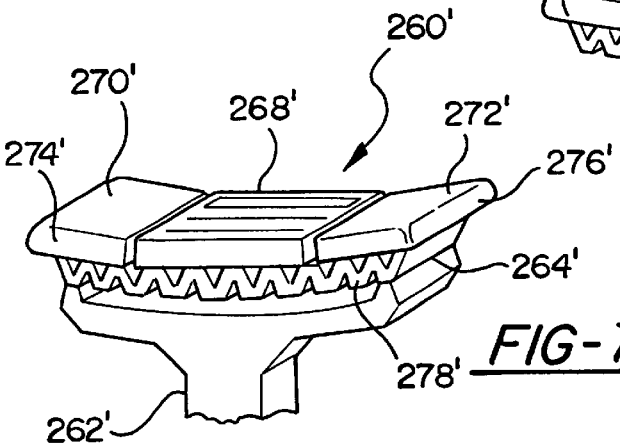
FIG. 7B shows a seventh embodiment having a concavely curved configuration for a razor head structure and outboard side glide surfaces, mounted upon a corresponding or concavely curved flexible base portion, attached at the ends thereof to a two-pronged yoke structure on the upper end of the handle portion.

FIG. 7B shows concavely curved razor head structure 260' of the present invention. Its head base portion 264' is constructed in a flexible configuration and is attached to handle portion 262' only near the two outboard ends thereof, to permit the entire length of portion 264' to flex. The configuration of base 264' is suitable for the attachment of flexible curved razor head structure 268', and curved extension portions 274' and 276', all of which are preferably arranged in an upwardly or concavely curved configuration. This configuration nominally holds glide surfaces 270' and 272' in a slightly upwardly oriented or curved state. Base portion 264' includes flexible support portions 278' for providing base portion 264' with the ability to flex upon the application of force to extension portions 274' and/or 276' through contact with the skin. The upper portion of handle 262' includes a curved yoke section that open underneath the razor blade section 268', while only the two outboard branch sections connect to and support the base portion 264'. This arrangement for the skin-engaging force-applying glide surfaces is beneficial because it helps position the razor-sharp edges of the razor blade strips, which strips are preferably flexible, in close gentle contact with the skin to be shaved, while allowing the non-shaving glides on either side the razor blade strips to engage and re-shape the skin to be shaved and subcutaneous tissue with a significantly greater non-shaving force. In other words, this entirely flexible base portion 264' and the means for outboard support of this base portion helps ensure a relatively low blade force against the skin even as the glides apply considerably more pressure to the skin and tissue directly adjacent to the centrally located strip of skin therebetween that is to be shaved.

Figure 8:
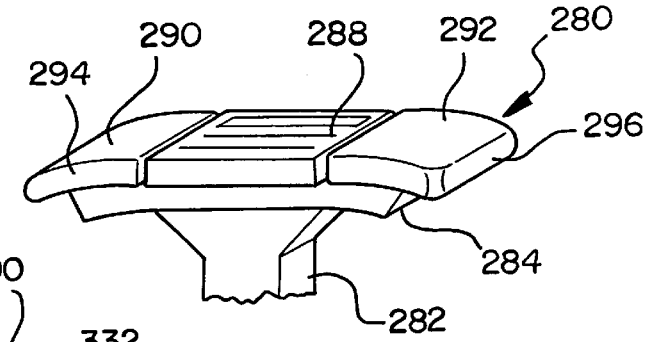

FIG. 8 shows yet another embodiment, namely elongated razor head structure 280, of the present invention, which includes base portion 284, of a generally downwardly or convexly curved configuration, attached to handle portion 282, in similar manner as before. The configuration of base portion 284 is suitable forthe attachment of razor head structure 288, and spaced apart extension portions 294 and 296, and glide surfaces 290 and 292, all of a generally downwardly or convexly curved configuration.

In the embodiments of FIGS. 1–8, adjustments may be made to the curvatures or contours of the components in one or two directions relative to some reference, such as central axes of the razor head structure or its base portion, or lines tangent to the blade edges there within. In other words, the curvature or contour of any of these components of the razor heads may be adjusted as viewed in a single vertical plane parallel to, or orthogonal to the longitudinal axis of the razor head structure or the blade or blades forming part of the included razor blade structure. The curvature or contour of any of these components may also be adjusted relative to both of these perspectives simultaneously, to the same or a different degree. The examples set forth below show adjusted curvatures from a front view, in a single vertical plane parallel to a longitudinal axis of the razor head structure. Therefore, it should be appreciated that the descriptions of concave or convex curvatures are intended to refer only to the configuration viewed in such a single vertical plane, but curvatures in an orthogonal direction are also contemplated.

Figure 9:
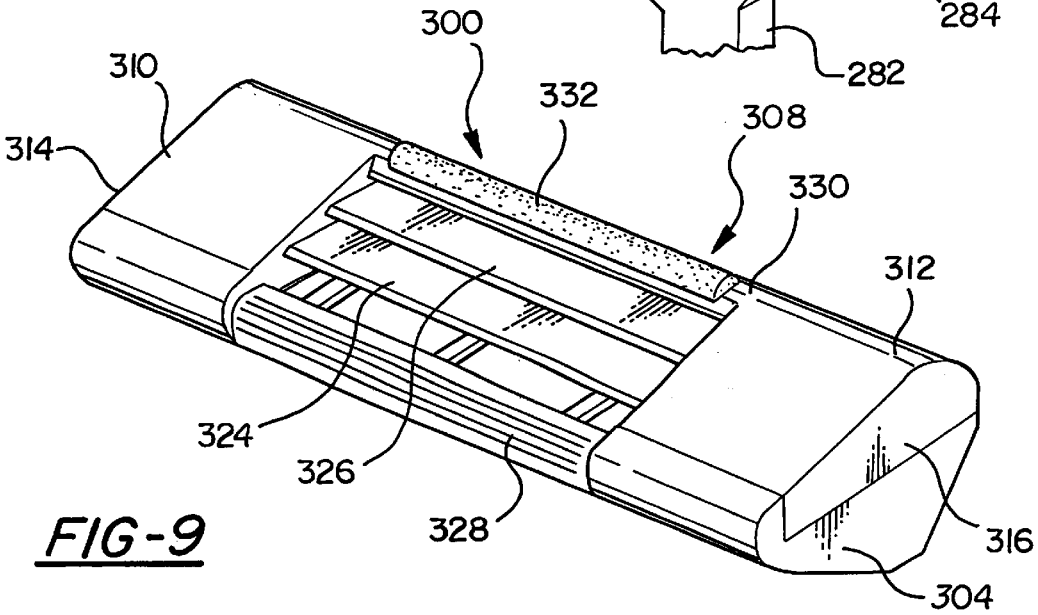
FIG. 9 shows a ninth embodiment of a shaving head structure of the present invention, in a perspective view, which has a centrally-located razor head cartridge structure and extension portions with covers, mounted upon a base portion.
Figure 10:
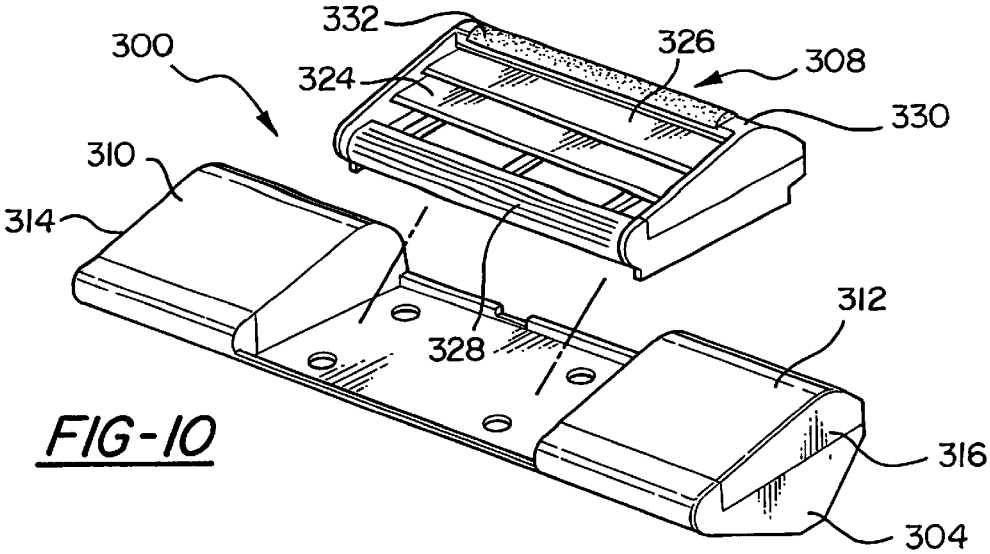
FIG. 10 is a partially exploded perspective view of the FIG. 9 head structure.

FIGS. 9 and 10 show assembled and exploded views, respectively, of another version of razor head device of the present invention, namely structure 300, suitable for attachment to a handle portion by any means set forth herein or known to those skilled in the art. Elongated structure 300 includes head base portion 304, supporting and suitably attached to centrally-located razor head structure 308. In this embodiment, however, glide surfaces 310 and 312 on either side of razor head 308 are provided as surfaces of cap portions 314 and 316, also attached to base portion 304. Cap portions 314 and 316 may be attached to base portion 304 through the use of pins and recesses, such as the arrangement shown in FIG. 3, or may be clipped onto the base portion 304 or attached in any other suitable manner. Caps 314 and 316 each have an upward slope from the front to the rear, which corresponds to the upwardly-sloped working plane for the sharpened edges of razor blades 324 and 326 formed by front and rear guard members 328 and 330. Rear guard 330 includes lubricant strip 332. Cap portions 314 and 316 are preferably formed of a plastic or metal material, may optionally include a suitable coating for enhanced performance, and may be of the same material as other portions of the head structure. The available material selections also apply for cover portions and extension portions integrally formed with the base portion. Other configurations for such cap portions, covers and integrally formed extensions having glide surfaces which complement the working plane are also envisioned, and some examples are set forth in the embodiments described below. FIGS. 11–16 illustrate some alternative configurations available for the large-area glide surfaces located adjacent to the razor head structures in the present invention, and will now be discussed.

Figure 11:
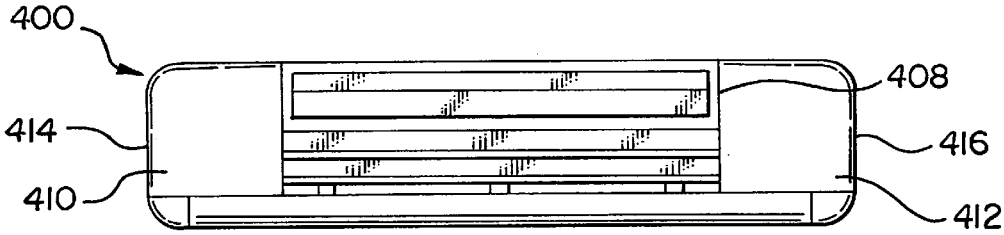
FIG. 11 shows a tenth embodiment, in a top view, of another head structure according to the present invention, having a razor head structure and extension portions with planar glide surfaces having rounded corners and an attached underlying base portion.
Figure 12:
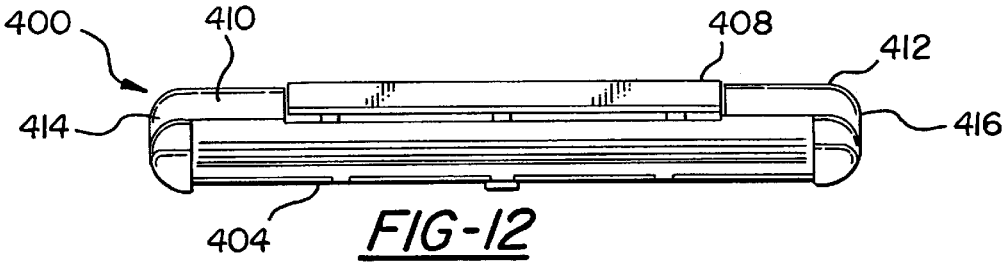
FIG. 12 is a front view of the head structure shown in FIG. 11.

FIGS. 11 and 12 show top and front elevational views, respectively, of another embodiment of the present invention, namely razor head structure 400, which includes base portion 404 with central razor blade structure 408 attached thereupon, in similar manner as before. Its cap portions 414 and 416 are also attached to base portion 404 to provide glide surfaces 410 and 412 adjacent to and on either side of razor head 400. As can be seen in FIG. 12, non-shaving glide surfaces 410 and 412 are generally in a co-planar arrangement with the working plane of razor head structure 400.

Figure 13:
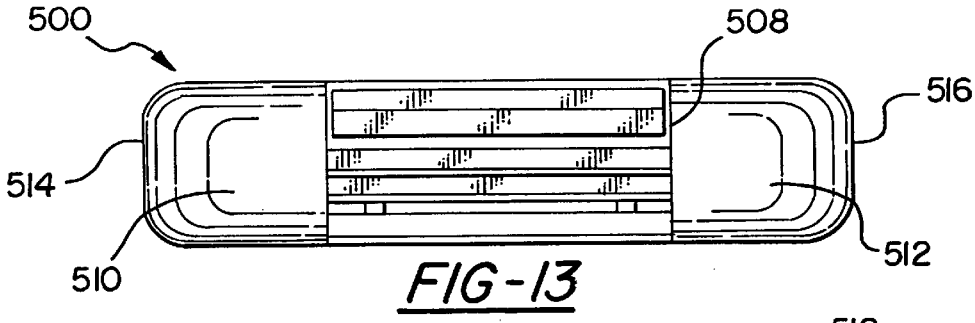
FIG. 13 shows an eleventh embodiment of another head structure according to the present invention, in a top view, which has a razor cartridge structure of shorter length than the previous embodiment and has extension portions with partially convexly curved glide surfaces on an underlying base.
Figure 14:
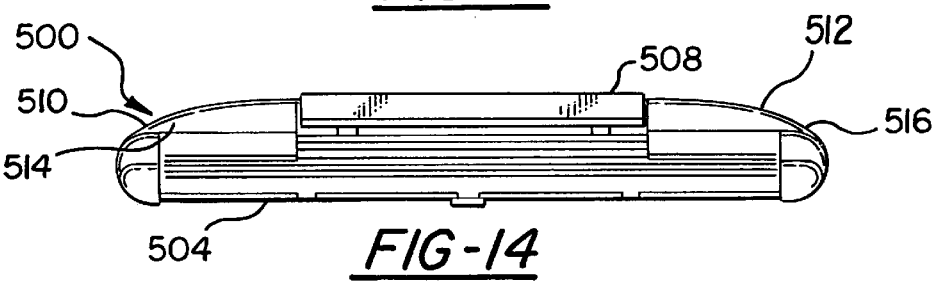
FIG. 14 is a front view of the head structure shown in FIG. 13.

FIGS. 13 and 14 are top and front elevational views, respectively, of razor head structure 500, another embodiment of the present invention, which includes base portion 504 to which razor head 508 is centrally attached. Structure 508 is of a somewhat shorter length than razor head structure 408 set forth in FIGS. 11 and 12. (It should be appreciated that any of razor head structures set forth herein may take on different lengths, as may be suitable or desired.) These figures also show cap portions 514 and 516 attached to base portion 504 at either side of head structure 508. However, cap portions 514 and 516 are configured to provide glide surfaces 510 and 512 having a planar portion near razor head structure 508 and a downwardly or convexly curved profile, viewed from the front, near the edges of head structure 500.

Figure 15:
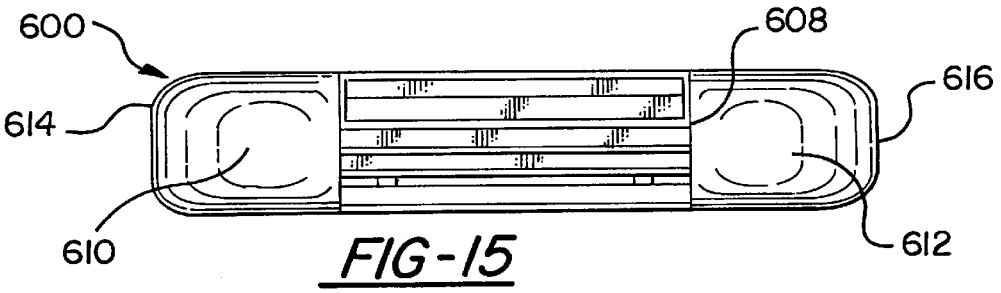
FIG. 15 shows a twelfth embodiment of yet another head structure, in a top or plan view, which has a narrower width than the FIG. 13 head structure with extension portions upwardly or convexly curved glide surfaces elevated above the working plane, wherein the extension portions are formed integrally with an underlying base portion.
Figure 16:
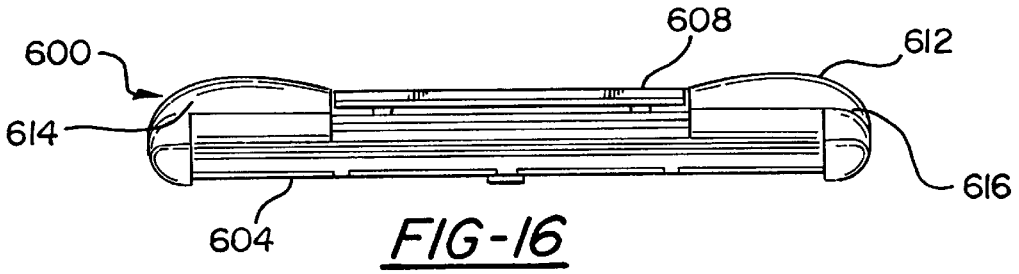
FIG. 16 is a front view of the head structure shown in FIG. 15.

FIGS. 15 and 16 are top and front elevational views, respectively, of yet another embodiment, namely head structure 600, which includes base portion 604 upon which razor head structure 608 is attached. This embodiment has extension portions 614 and 616 provided as integral formations of base portion 604, with gliding surfaces 610 and 612 configured in a curved elevated fashion above the surface of razor head structure 608. This demonstrates that the glide surfaces may also be elevated above the razor head structure in whole or in part. In addition, these glide surfaces may each have a curved profile from the front to the rear of the head structure or from side to side of the head structure, either alone or in combination. These Figures also show the razor head structure 608 is of even shorter length than the razor head structure 508 shown in FIGS. 13 and 14.

Figure 17:
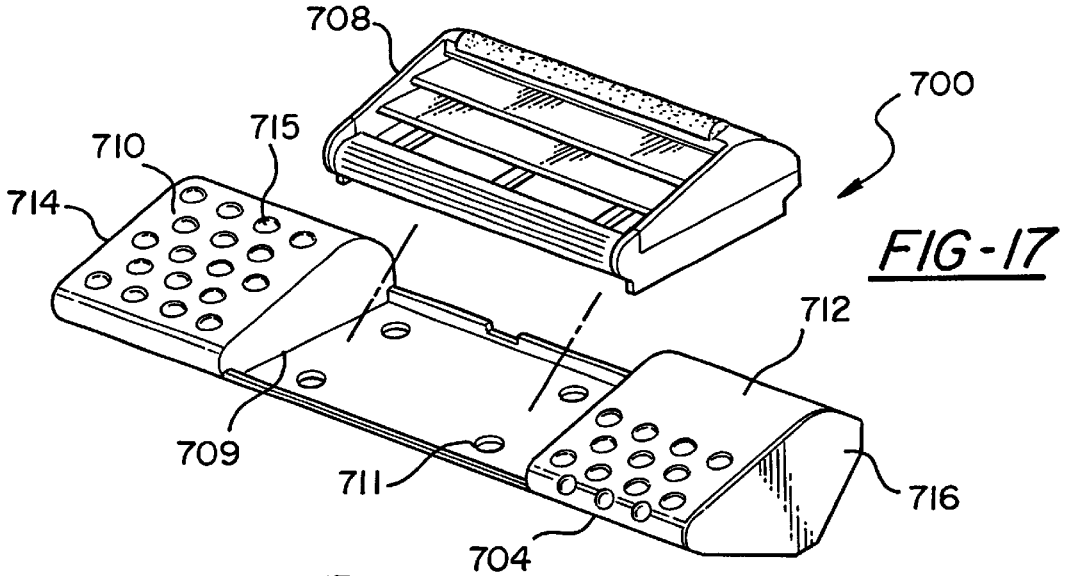
FIG. 17 shows a thirteenth embodiment, in exploded perspective view of another embodiment of head structure of the present invention, with a razor cartridge structure removably attachable to a base portion having integrally formed extension portions with glide surfaces.
Figure 18:
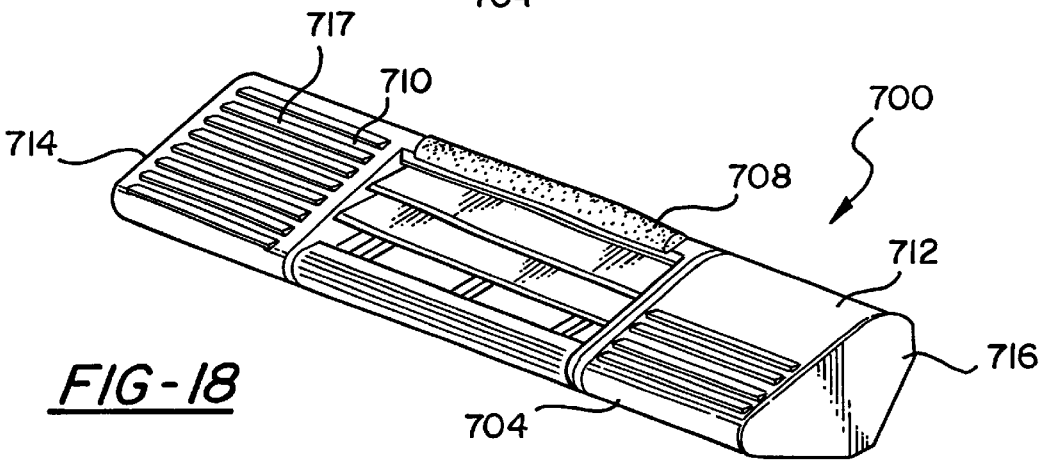
FIG. 18 is a perspective view of the FIG. 17 head structure assembled.

FIGS. 17 and 18 are exploded and assembled views, respectively, of head structure 700 of one embodiment of the present invention. Structure 700 includes base portion 704 and razor head structure 708, in similar manner as before, with portion 704 including a recess 709 for receiving structure 708. Apertures 711 disposed upon base portion 704 are provided for receiving pins (not shown) located upon the lower surface of structure 708. Base portion 704 also included integrally formed extension portions 714 and 716, which respectively have glide surfaces 710 and 712 formed on their upper surfaces. These glide surfaces are substantially flush with the upper surface of razor head structure 708 in a substantially planar arrangement.

FIG. 17 also shows grip-enhancing textured surface formations, namely a plurality of dimples 715, disposed upon extension portions 714 and 716 for assisting in the gripping or pulling the skin during shaving, if that should be desired. The arrangement of dimples 715 are shown differently upon each extension portion to illustrate that they may cover all or part of a particular extension portion, and may even be disposed around curved regions of these surfaces. Dimples 715 are preferably made of any conventional or suitable material (including those previously described herein) to enhance gripping by friction and/or mechanical engagement with the skin during wet or dry shaving conditions, and with or without the use of a shaving lubricant. Dimples 715 may be configured to be part of the same material from which the extension portions are made, or may by in the form of an insert, an overlay or any other suitable attachment or integration, and are preferably a soft rubber or soft synthetic polymer material.

FIG. 18 shows a different configuration for grip-enhancing textured surface formations upon extension portions 714 and 716. Here, a plurality of spaced elongated parallel fins 717 are provided upon extension portions 714 and 716, and are preferably tilted in a direction facing the direction of shaving movement. Fins 717 may be provided upon all or part of extension portions 714 and 716, and may be formed in the same manner, and of the same materials set forth above for the dimples. Fins 717 may also be disposed in any suitable configuration, size and direction to achieve the gripping or pulling of the skin during shaving by friction or mechanical engagement. For example, they may be made of a soft pliable synthetic rubber or polymer. It should be appreciated that any of the other configurations for the glide surfaces and the razor head structure may also employ these grip-enhancing surface formations. These figures demonstrate that razor head structures may be attached in different ways to base portions having either attachable (as in FIGS. 9 and 10) or integrally formed (as in FIGS. 17 and 18) extension portions with glide surfaces.

Figure 19:
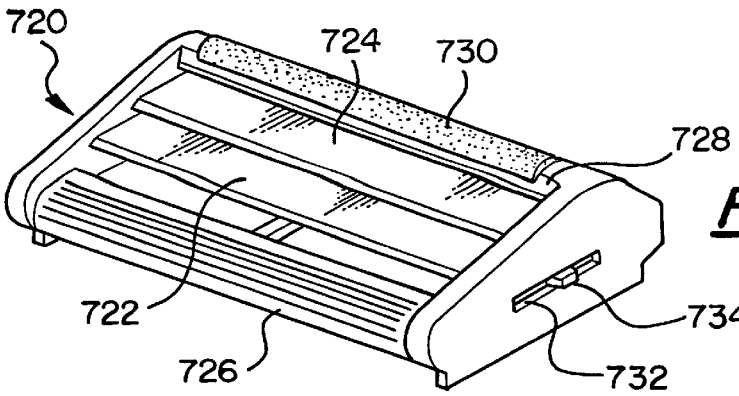

FIGS. 19–22 show four different versions of razor head structures suitable for attachment to the base portion 704 shown in FIGS. 17 and 18, or upon base portion 304 shown in FIGS. 9 and 10. FIG. 19 shows cartridge structure 720 having twin spaced generally parallel razor blade strips 722 and 724. Front and rear guard members 726 and 728 form a working plane for razor blade strips 722 and 724, and may have lubricant strips 730, in similar manner as before. Razor blades 722 and 724 are carried in a conventional carriage internal to structure 720 to give the blade strips the ability for front-to-rear sliding motion, based upon being connected to the internal carriage (not shown) that is guided in part by a pair of opposed pins, such as pin 734, which travel in a front and rear direction within respective complementary opposed slots, such as slot 732.

Figure 20:
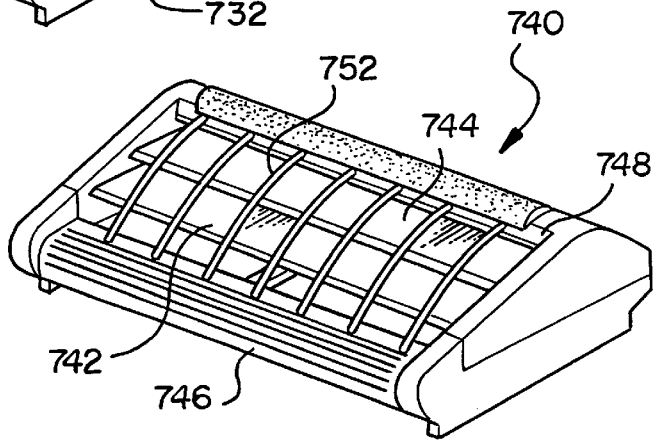

FIG. 20 shows another embodiment of the present invention, namely razor head structure 740. Head 740 has a set of razor blade strips 742 and 744 and a working plane for them defined by front and rear guard members 746 and 748 in a similar manner as before. Razor head structure 740 is further provided with wire guard 752 which is preferably constructed from a single thin wire wrapped sequentially around razor head structure 740 in parallel sections perpendicularly across the exposed razor-sharp blade edges at regular intervals. The spacing of the wire sections preferably is on the order of about 2.5 mm (about 0.1 inch). The details of the constructing substantially parallel wire guards across the blade edges in the direction of shaving is well-known, as has taught for example in U.S. Pat. No. 5,063,668 to Althaus, and thus need not be further described here.

Figure 21:
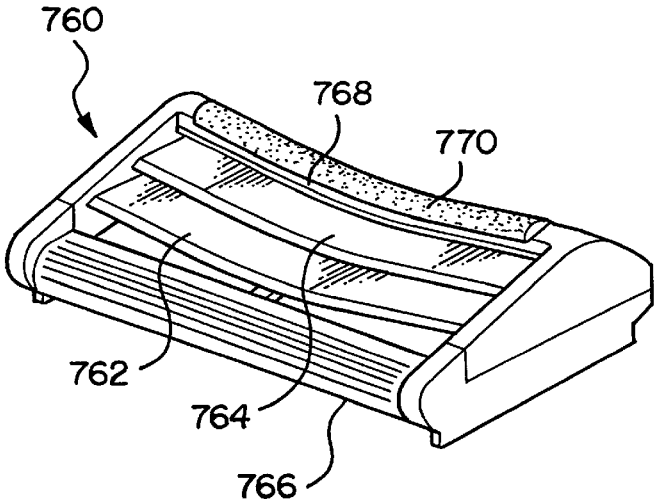

FIG. 21 shows an embodiment, namely razor head structure 760, which employs non-shaving pads and a curved razor blade configuration suitable for shaving curved skin surfaces. Specifically, razor head structure 760 includes two parallel razor blade strips 762 and 764, spaced in between front and rear guard members 766 and 768 which form a working plane in which the razor-sharp edges are reside. Lubricant strip 770 is provided on and forms part of rear guard 768. The curved configuration for razor head structure 760 may be constructed as either a pre-curved configuration for all of the components of razor head structure 760, or as a flexible design for the razor strip structure which is placed in a pre-curved underlying base portion. In the case of a flexible razor head structure, deformation of the razor head structure 760 from either a planar or pre-curved configuration is achieved through the application of force to the structure through an attached handle portion. It should be appreciated that some of the components of razor head structure 760 may be flexible while others may remain relatively inflexible.

Figure 22:
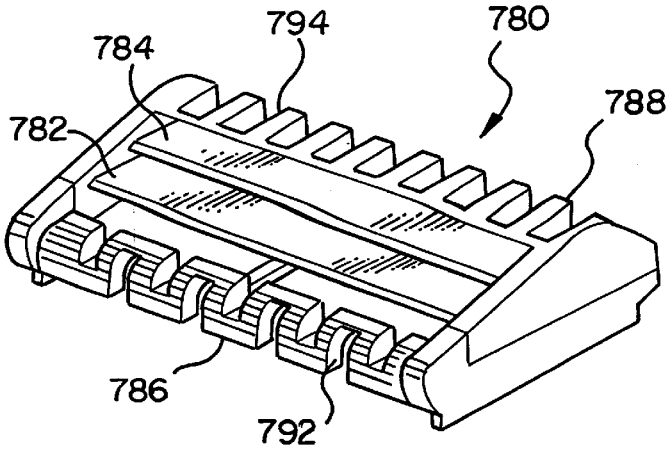

FIG. 22 shows flexible razor head 780 of yet another embodiment of the present invention. Head structure 780 includes spaced parallel razor blade strips 782 and 784, each having razor-sharp edges which project into a working plane defined in part by front and rear guard members 786 and 788 for safe shaving. Guards 786 and 788 include a series of slots 792 and 794, respectively, for imparting flexibility to the guard members. Preferably, razor blades 782 and 784 are constructed of very thin flat strips of suitable metal alloy which are also flexable, which makes razor head structure 780 flexible as a whole.

Figure 23:
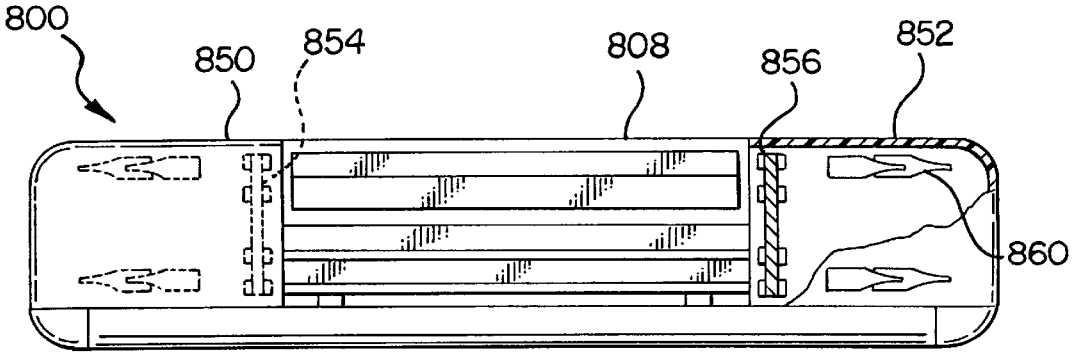
Figure 24:
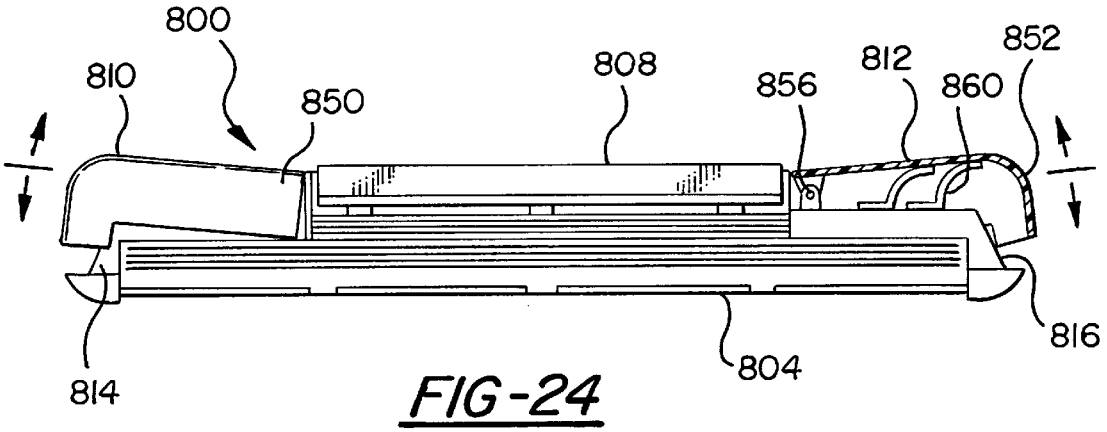
Figure 25:
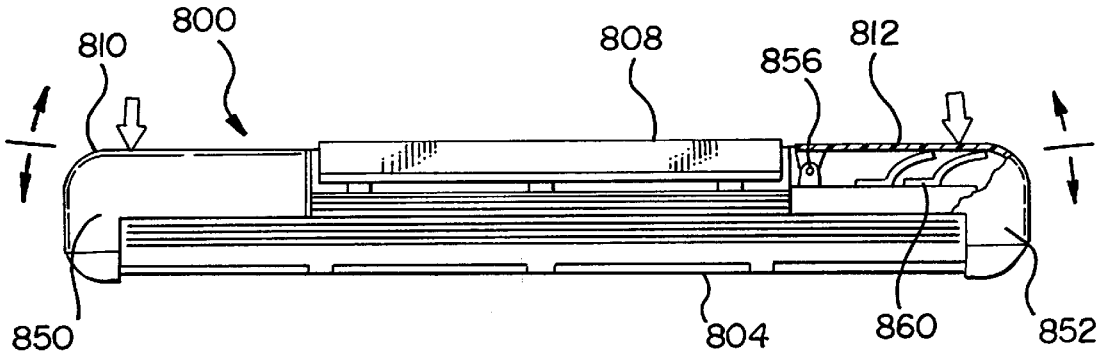

FIGS. 23–25 show yet another embodiment of the present invention, namely head structure 800, which includes base portion 804 upon which razor head structure 808 is attached. Extension portions 814 and 816 are attached to base portion 804 at either side of razor head 808. In this embodiment, portions 814 and 816 do not directly provide the glide surfaces as described in previous embodiments; instead, they provide platforms for the mounting of movable or spring-loaded glide surface structures. Specifically, head structure 800 includes cap structures 850 and 852 which are mounted upon extension portions 814 and 816 by means for movable attachment such as hinge assemblies 854 and 856. These hinges are shown located near the edges of razor head structure 808, so that cap structures 850 and 852 pivot about those locations in a direction transverse to the longitudinal axis of head 800. It should be appreciated, however, that the hinges may be located at any suitable position, and may even be arranged to allow cap structures 850 and 852 to pivot in other directions. Springs 860 located under extension portions 814 and 816 are provided to tend to force cap structures 850 and 852 in an upward direction. Springs 860 are preferably formed as a leaf spring of a resilient plastic material secured at one end only. It should be appreciated that other suitable spring designs and suitable metal or other materials may also be used. Plastic springs 860 may be formed as part of the cap structures or the extension portions. Or springs 860 may be individual components such as very lightweight coiled helical springs mounted on suitable central plastic anchors or posts or in suitable circular recesses.

This assembly 800 described above provides glide surfaces 810 and 812 as upper surfaces of spring-loaded cap structures 850 and 852. In operation, springs 860, which may be suitably staggered sizes according to their position beneath cap structures 850 and 852, force cap structures 850 and 852 to a slightly inclined position relative to head structure 808. Application of force upon structure 800 against an underlying skin surface being shaved causes springs 860 to deflect, thereby tending to close cap structures 850 and 852 upon extension portions 814 and 816, as shown in FIG. 25.

Figure 26:
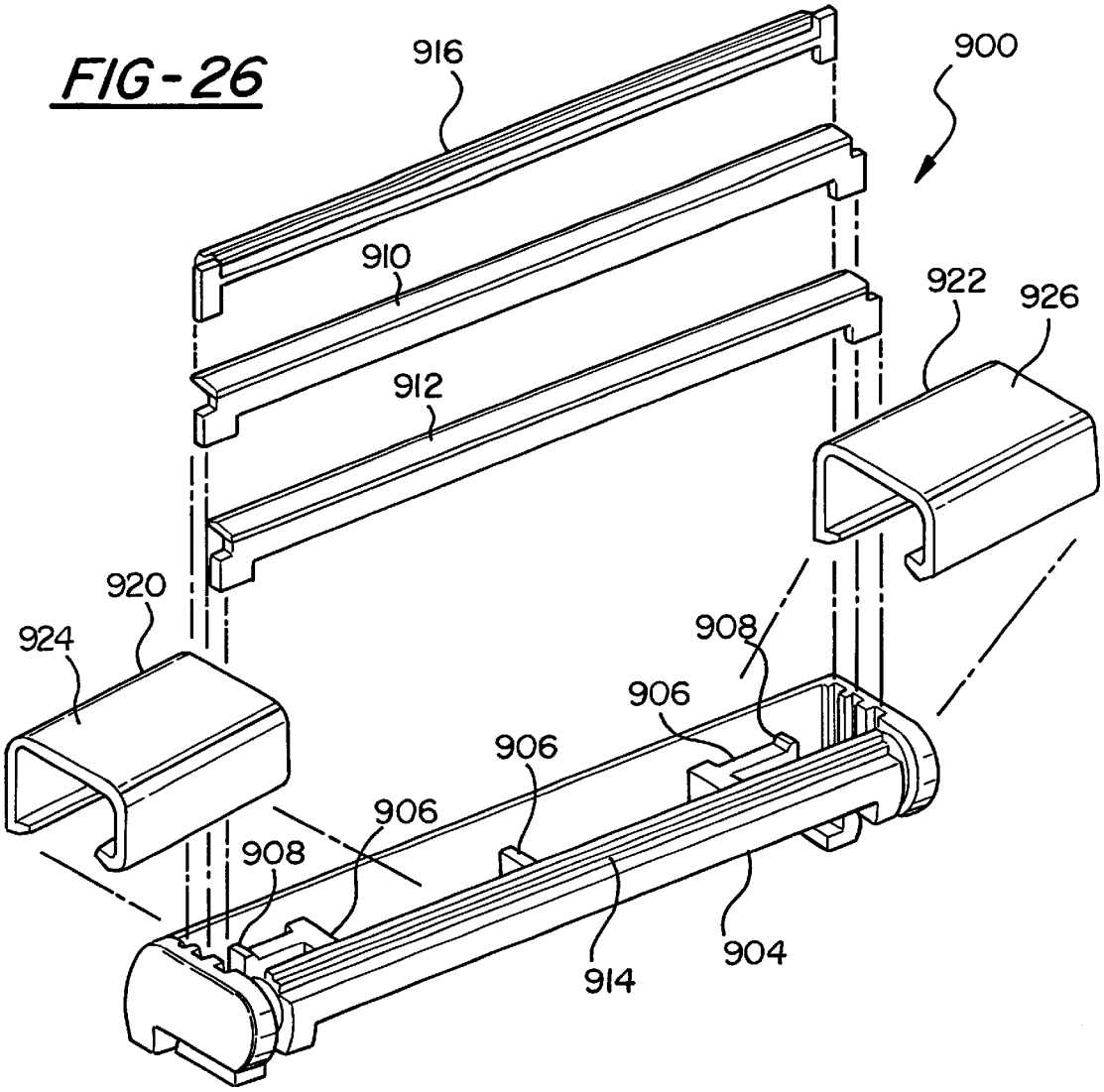
FIG. 26 shows a fifteenth embodiment, in an exploded perspective view, of yet another embodiment of head structure according to the present invention, including a floating razor blade structure and covers that clip upon the base portion over the end portions of the floating blades to shorten the effective blade length, and provide large-area glides on either side of the exposed razor-sharp edges of the blades.
Figure 27:
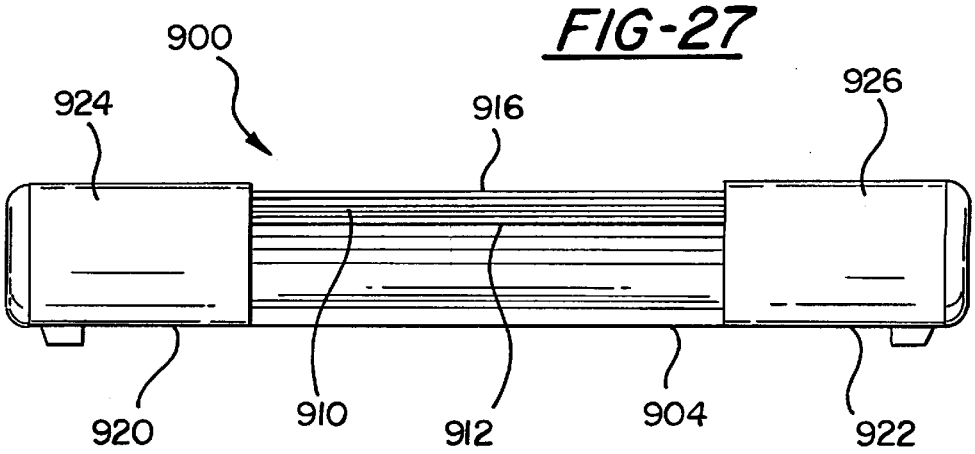
FIG. 27 is a front elevational view of the head structure of FIG. 26, in assembled form, showing the exposed blade edges and glides formed by the covers.

FIGS. 26 and 27 show in exploded and assembled views of razor head structure 900 of the present invention, which has exposed blade strips of relatively short length. This reduction in exposed blade edge length is achieved by having the opposed glide surfaces cover the end portions (i.e., a selected length) of a standard-length conventional manual razor head, which may be of any type that is commercially available. Covering the end portions of head structure 900 with a suitable non-shaving protective glide structure is thus an alternate means for achieving a shortened exposed razor blade length with the symmetrically-arranged side glide surfaces of the present invention. Specifically, head structure 900 as shown includes base portion 904 having blade supports 906 and spring members 908 for retaining and resiliently biasing blade assemblies 910 and 912 upwardly. In similar manner as before, front guard 914 and rear guard 916 cooperatively define a working plane into which the razor-sharp edges of razor blade assemblies 910 and 912 project, for safe shaving. In this embodiment, cap portions 920 and 922 are inserted over opposite end sections of head structure 900 to shield the exposed razor-sharp edges of these end portions from direct contact with skin surfaces during shaving. Cap portions 920 and 922 are shown to be of a clip-on form, although any suitable attachment configuration for the non-shaving cap portions may be used. Further cap portions 920 and 922 may be constructed and contoured in any suitable configuration so that glide surfaces 924 and 926 formed upon assembly achieve the desired resulting glide profiles and surface textures, including any of those described elsewhere herein. The relative lengths of glide surfaces 924 and 926 and the exposed portion of head structure 900 are preferably as previously described relative to the shaving and non-shaving portions of the FIG. 1 embodiment.

Figure 28:
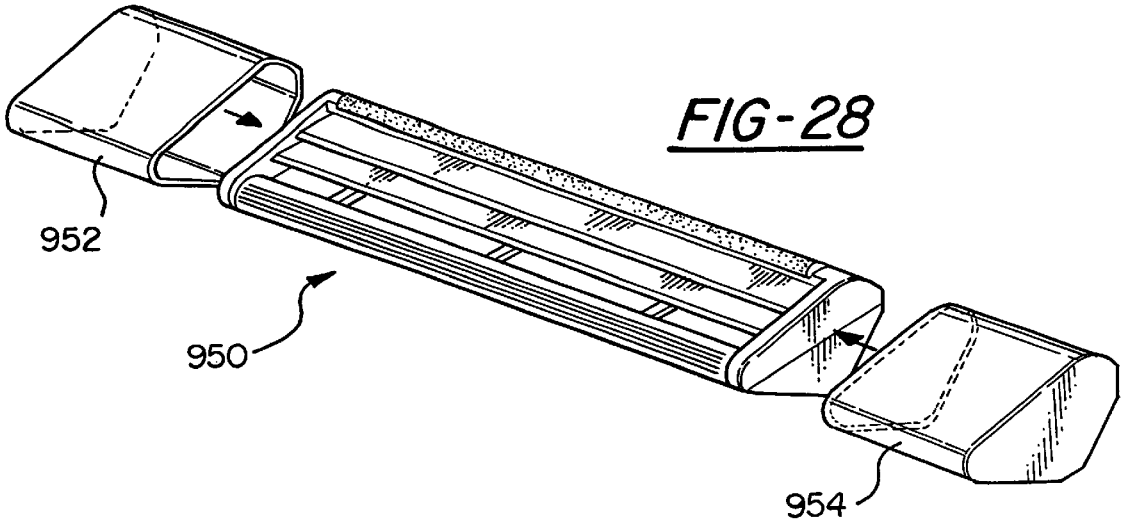
FIG. 28 shows a sixteenth embodiment, in a partially exploded perspective view, of the head structure according to the present invention, with the glides formed by covering the ends of a conventional-length blade structure by end caps.
Figure 29:
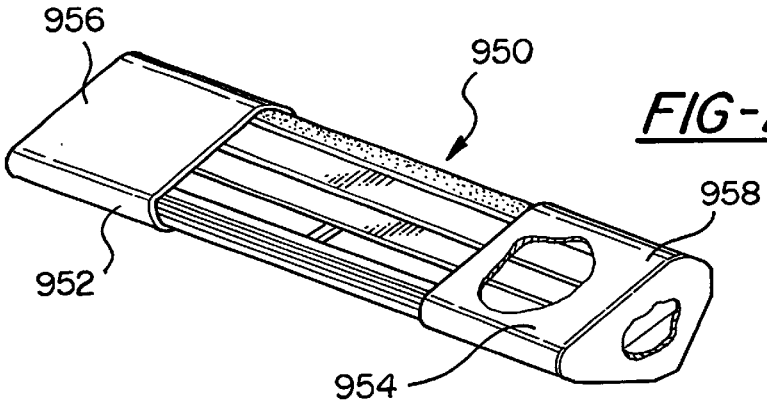
FIG. 29 is a perspective view of the FIG. 28 structure in assembled form, with the right side end cap partially cut away to reveal blade portions covered below.

FIGS. 28 and 29 show the present invention also contemplates different means for covering end portions of conventional razor head structures to form the non-shaving glide surfaces to be used for purposes previously described herein. These Figures are disassembled and assembled views, respectively, of head structure 950 with first and second end caps 952 and 954, which are placed upon the end portions of head structure 950, so as to shield these end portions from direct contact with the skin surface during shaving. End caps 952 and 954 are provided as generally hollow tube-like formations of plastic or other suitable material. The attachment of end caps 952 and 954 upon head structure 950 operates to form glide surfaces 956 and 958. The caps may be formed of rigid plastic material or softer, semi-pliable synthetic rubber or polymer material. In either case, the caps are preferably sized to snugly engage by friction corresponding surfaces of the conventional T-bar razor head structure. Alternatively, interlocking tabs and recesses can be.

Figure 30:
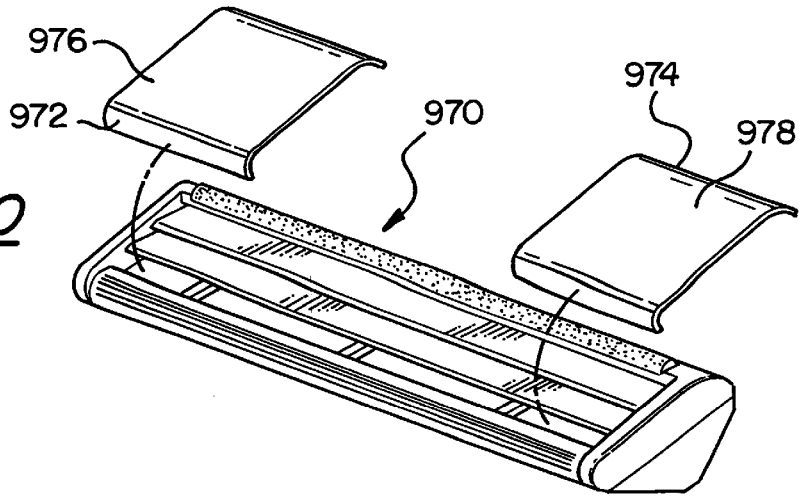
FIG. 30 shows a seventeenth embodiment, in a partially exploded perspective view, of head structure according to the present invention, where the glides are formed by shielding the ends of conventional-length blade structure can be shielded by detachable covers.
Figure 31:
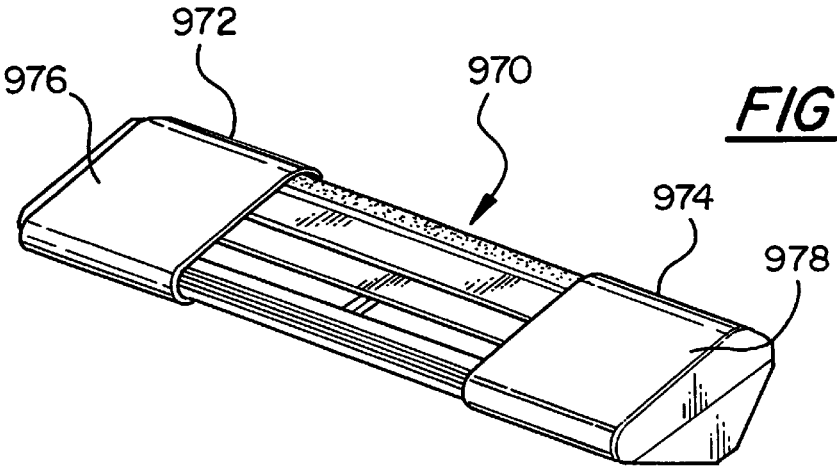
FIG. 31 is a perspective view of the head structure of FIG. 30, in assembled form, showing how the covers reduce the exposed length of the razor blades.

FIGS. 30 and 31 show yet another alternative embodiment for partially shielding the head structure from direct skin contact. In this embodiment, head structure 970 includes end covers 972 and 974 attached to the end portions of head structure 970 by being clipped or otherwise fixed. The attachment of end covers 972 and 974 results in the formation of glide surfaces 976 and 978.

Figure 32:
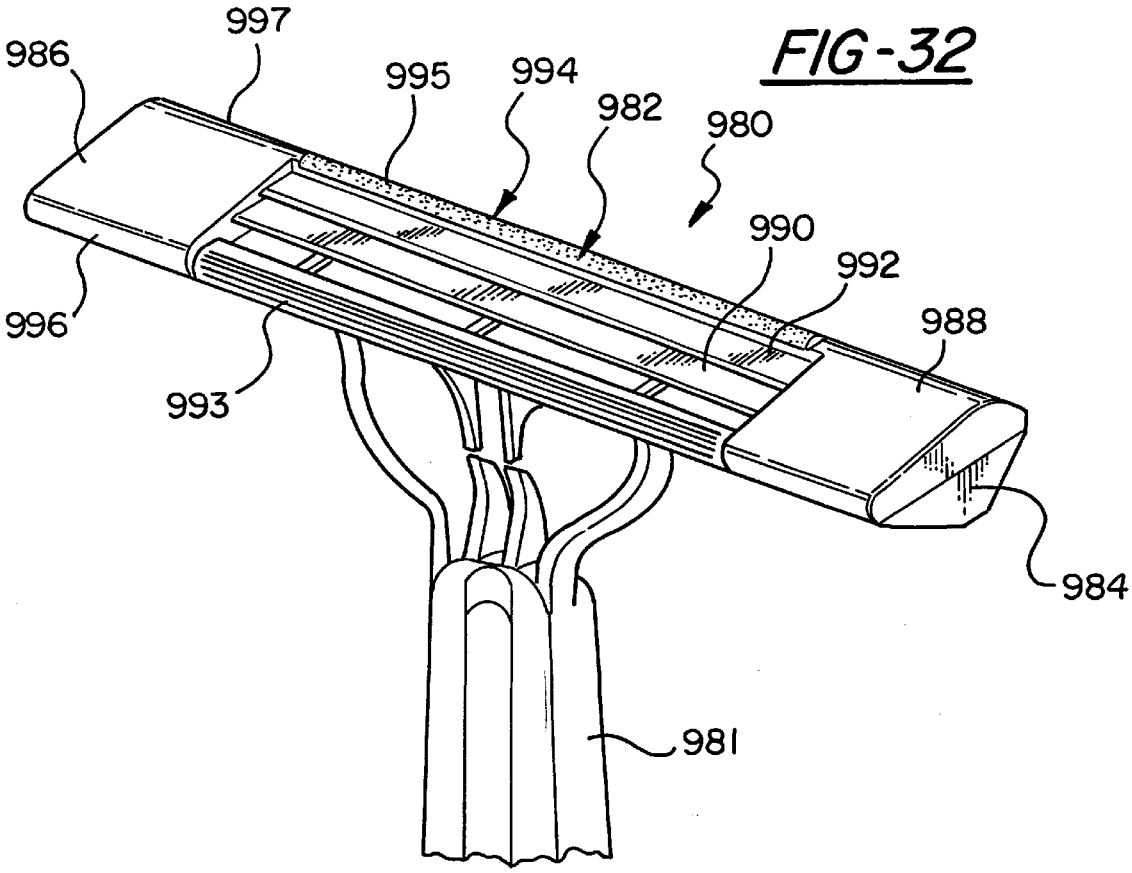
FIG. 32 shows an eighteenth embodiment of a razor head structure of the present invention, in a perspective view, having a conventional-length removable razor blade cartridge structure located in between two large-area side glide sections.

FIG. 32 shows, in perspective view, T-bar razor shaving device 980 having handle 981 upon which a double-bladed razor head structure 982 of conventional length (e.g., about 32 mm to 38 mm; or about 1.3 or 1.5 inches) is mounted. Structure 982 includes elongated razor head base 984 with two extension portions on either side of the razor blade strips, which portions have large-area glide surfaces 986 and 988. Like in other embodiments, twin parallel razor blade strips 990 and 992 have their razor-sharp edges disposed between and spaced from front and rear guard members 993 and 994, which guards define a working plane for the razor-sharp blade edges. Rows of parallel ribs or fins, as shown, may serve as the skin-engaging surface the front guard, while elongated lubricant strip 995 may serve as the skin-engaging surface of rear guard 994. In this embodiment, the glides 986 and 988 are each shown to have rounded front and rear edges 996 and 997 of about 1.2 mm radius (about 3/64 in. radius), and a generally square shape when viewed from above approximately 11 mm (7/16 in.) long by 11 mm (7/16 inch) wide. As such the length of each glide is about one-third of the length of exposed razor blade strips 990 and 992. This embodiment shows that the large-area glides of the present invention may be used on relatively large razor heads if desired. While the razor blade strips of this embodiment are straight, clearly the large-area glides may also be used on a similar razor shaving device having elongated and somewhat curved razor blade strips as well to equally good effect.

It is worth noting that, in a number of shaving applications, the large-area non-shaving, force-applying side surfaces of the present invention, called glides or wings, have the benefit of providing an additional tactile sensation to the user. For example, consider a person who is shaving his or her underarms, and how they are at a distinct disadvantage, in comparison to shaving their face or legs, since they cannot see the underarm area very well. At best, the user can only look what he or she is doing in a mirror at least about 50 cm (20 inches) and more likely 75 cm or 100 cm (30 or 40 inches) away in terms of visual distance from the area. (The distance is doubled in that the image must bounce off of a mirror and then back to the user's eyes.) By providing a T-bar razor of the present invention with a relatively small head but large non-shaving areas on either side of the razor blade strips, the user can safely press the face of the shaving head into the underarm areas without worrying about increasing the number of cuts or nicks. Also, a user of the improved shaving devices of the present invention can more readily obtain a sense of where she or he is shaving by a sense of feel or pressure in the underarm area, in comparison to conventional T-bar style razors, which must be lightly stroked to avoid creating cuts and nicks.

As briefly mentioned above with respect to FIG. 1, the non-shaving skin-contacting glide surfaces of the present invention may be provided with, or substantially covered in whole or part, with a porous liquid-receiving relatively smooth material, so as to provide the user with additional tactile sensations and a feeling of comfort in using the razor shaving devices of the present invention. For example, many users of conventional manual razors run the cartridge under warm water before applying it to their body. This avoids the feeling of a cold object being placed upon that part of the body to be shaved. (Also it is necessary to rinse off cut hair stubble and shaving cream or foam from time to time.) It is also well-known that water helps soften the hair to be shaved, and helps allow the razor blade strip to better engage the hair stubble to be shaved. However, with respect to the underarm area, there is a problem with providing moisture to that area as part of the shaving operation. A liquid-bearing pad or layer will help provide the requisite moisture which lubricates the contact between the razor head and the skin. Also, a liquid-bearing layer will provide an enhanced tactile sensation, since the liquid within the pad may be pre-warmed by running the razor head under the hot water from the faucet moments before it is used. The pad or layer may be provided with water-soluble emollients which can be applied to the skin to act as a lubricant and/or skin conditioner. In summary, the liquid-bearing glide pads provide not only enhanced tactile feel, but can provide the foregoing functional benefits as well. This, coupled with the reduced size of the exposed blade edges, will help the user be less concerned about discomfort and hazards when shaving the underarm areas or other sensitive, hard-to-reach parts of the body. Accordingly, I expect users of the improved shaving devices of the present invention to feel more comfortable with shaving the underarm area thoroughly by repetitive shaving strokes, without having to continuously look in a mirror to avoid necks razor burn or other discomfort.

Another advantage of the large non-shaving rounded glides and reduced blade length in some of the embodiments of the present invention is that the tendency of the soft skin to pile up or buckle in front of the advancing blade (for example, where the skin is extra flabby), is reduced. It is reduced because of the extra pressure on the skin, and because of the reduced blade length, and because of the rounded glide surfaces, all of which help avoid a tendency to gather flabby skin in front of the razor-sharp blade edge. Thus, the total length of skin being pushed by or near the blade sharp edge at any one moment is reduced with the razor head structures of the present invention.

Another advantage of the glide-equipped manual shaving devices of the present invention is that it can be readily constructed with relatively straightforward modifications to regular shaving heads and support platforms. In other words, this new shaving technology only requires a relatively easily-understood modifications to the existing razor blade structures in order to commercialize the devices of the present invention.

Epilogue. Armed with the foregoing detailed description, those skilled in the art will readily be able to make and use the various embodiments of the present invention as described above. Accordingly, it is not necessary to further describe the manufacturing steps or further details of constructing the razor blade devices of the present invention.

As can be seen from the foregoing description of the various embodiments, the overall size of most of my manual shaving razor devices with non-shaving side glide surfaces will very likely be regarded by a typical user of a wet razor as smaller than, or being really no bigger or heavier than conventional wet razors that she or he may be using. I believe that the size, weight, balance and overall appearance of my razor blade devices with glide surfaces should be readily accepted by consumers. Further, once the distinct advantages of such razors and shaving techniques are appreciated by consumers, these razors may well achieve widespread use. Moreover, the side glide surfaces of the present invention can be used with manual razor blade shaving devices of a larger-than-conventional size, and/or with razor blade shaving devices having curved blades.

The term "razor blade" or "razor blade strip" as used herein, including the claims, encompasses any elongated razor blade or razor blade strip having a razor-sharpened edge, no matter how constructed, and no matter whether flat or angled. Thus, this term covers razor blade strips made of a single piece of metal or other sharpened or sharpenable material. It also covers razor blade strips made by bonding a thin gauge strip of metal to a more rigid piece of metal, by laser spot welding or the like, like the blades used in the Gillette Sensor and Gillette Mach3 razors.

Those skilled in the field will appreciate that the foregoing illustrated and discussed embodiments of the razor blade structures and devices of the present invention are subject to modification and change without departing from the scope of the invention as recited in the claims below. Needless to say, the size, proportion, materials, weight and clearances of the various components used in the razor heads, handles and movable connection head-to-handle mechanisms of the razor blade shaving devices of the present invention can be varied as needed or desired. A number of other possible modifications have already been described above. Further changes are clearly possible, as will now be discussed first in the following examples.

(1) In each of the various embodiments, different features and aspects of other embodiments may be combined with it to provide a razor blade shaving device with the desired features from both.

(2) In each of the various embodiments, one, two or three razor blade strips may be provided.

(3) The handle and base portion of each embodiment may be made as a one-piece construction.

(4) The base portion and razor blade structure may be constructed from preformed and/or pre-molded pieces assembled together with automatic equipment.

(5) One or more lubricant strips may used in each of the embodiments, and may even cover all or a part of the non-shaving glide surfaces.

(6) The non-stick outer layer of the glide surfaces may be built into the razor head structure through any known techniques including molding, spraying and vapor deposition, rather than being a separate layer glued onto the glide pad, and may be made of polytetrafluoroethylene (PTFE), or of molded plastic coated by vapor deposition or other suitable methods with a smooth, slippery, relatively wear-resistant and/or substantially inert layer. Such a layer may be made of gold, silver, chrome, one of their alloys, or any other metal suitable for contact with human skin, or a nontoxic vapor-deposited glassy material such as silicon oxide or the like.

(6) Any type of conventional or suitable pin or post arrangement may be utilized to retain the elongated blade strips within the razor head structures of the present invention. In addition, the blade strips may also be attached without the need for rivet portions by direct molding, or by being held captive in a suitable clamp between the cap and platform portions, such as the clamping mechanism disclosed in U.S. Pat. No. 4,403,413 to Trotta, which is hereby incorporated by reference.

(7) The sharpened edges of the rear blade strips in the various embodiment may be slightly elevated relative to the working plane defined by in part by sharpened edge of its forward blade strip, to optimize the cutting action of the rearward blade strips, by having each rearward blade protrude ever so slightly more than the blade strip in front of it.

(8) Any of my razor blade shaving devices disclosed above may be constructed as a detachable, replaceable cartridge-style razor head, and can be designed so that they can be used with any conventional or suitable reusable handle.

(9) Any combination of glide surfaces, including those with different textures or degrees of smoothness or slipperyness, may be used which accomplish providing the user with the ability to manipulate the underlying skin surface through the application of force while maintaining normal modest pressure of razor blade edge surfaces against the skin surface during shaving.

(10) Although the illustrated embodiments generally show T-bar arrangements between the head and handle, the razor head structures of the present invention may also be used with handles having other orientations relative to the head, such as in-line handles. In other words, different styles of razor blade heads employing one or more elongated razor blade strips may benefit by using one or two large-area non-shaving glide surfaces adjacent one or both ends of the elongated razor blade strips. This true whether the handle is connected in a T-bar arrangement to the razor head, or in some other arrangement.

Thus, it is to be understood that the present invention is by no means limited to the particular constructions herein disclosed and/or shown in the drawings. Instead, the present invention also encompasses any modifications within the scope of the disclosures or fair equivalents thereof, as long as they covered by the claims set forth below.

What is claimed is:

1. A manual razor blade shaving device for shaving soft, pliable, contoured underarm skin surfaces, comprising:

a hand-grippable portion, a head structure attached to and supported by the hand-grippable portion, the head structure having an elongated razor blade structure including elongated front and rear guard portions and at least one elongated razor blade having an elongated exposed razor-sharp edge suitable for shaving hair disposed between and spaced from the front and rear guard portions, the exposed razor-sharp edge having first and second exposed ends and an effective exposed blade edge length, and the guard portions defining at least in part a working plane in which the exposed razor-sharp blade edge projects, and first and second non-shaving skin-engaging pads respectively located adjacent to and outwardly of the first and second exposed ends of the razor-sharp edge, the first and second pads being arranged to be operable to transmit force applied to the head structure into the soft pliable skin surface under the non-shaving pads, and wherein the effective exposed blade edge length is no more than about 25 mm, a ratio of the average length of the first non-shaving pad to the effective exposed blade edge length is in the range of from about 1:1 to about 1:6, and a ratio of the average length of the second non-shaving pad to the effective exposed blade edge length is in the range of from about 1:1 to about 1:6, and the first and second non-shaving skin-engaging pads each having a curved configuration such that each pad has a generally curved profile when viewed from a distance in front of the elongated front guard portion of the head structure, and such that each pad provides generally non-binding, snag-free contact and travel over soft pliable contoured skin surfaces being shaved.

2. The manual underarm shaving device of claim 1 wherein:

the head structure has an longitudinal axis, and the exposed blade edge is generally parallel to the longitudinal axis;

the hand-grippable portion is elongated and has a major axis which is generally arranged perpendicularly to the longitudinal axis of the head structure;

the exposed razor-sharp edge is no more than about 25 mm long; and each of the first and second non-shaving pads has at least about 50 square mm of skin-engaging area.

3. The manual underarm shaving device of claim 2 wherein the head structure has a transverse center line generally perpendicular to the longitudinal axis, and the first and second non-shaving pads are arranged symmetrically about the transverse center line.

4. The manual underarm shaving device of claim 1 wherein at least a first portion of the head structure is arranged to be flexible in response to forces applied between the hand-grippable portion and the head structure during shaving.

5. The manual underarm shaving device of claim 4 wherein:

the head structure includes, as the first portion of the head structure arranged to be flexible, an elongated base provided with a central portion and first and second opposed extension portions located on opposite sides of the central portion, the first and second non-shaving pads being respectively disposed upon and forming part of the first and second extension portions, and the first and second extension portions being flexible relative to the central portion, whereby the first and second non-shaving pads are flexible relative to the central portion of the elongated base.

6. The manual underarm shaving device of claim 5 wherein substantially the entire base of the head structure including the central portion of the base is flexible.

7. The manual underarm shaving device of claim 6 wherein the hand-grippable portion includes:

an elongated handle section sized to be gripped between a user's fingers and thumb, and an upper connection section connected to the handle section, the upper connection section having a center region connected to the handle section, and first and second arm regions connected to the center region and located on substantially opposite sides of the center region, the first and second arm regions supporting and being connected to the first and second opposed extension portions of the central portion of the base.

8. The manual underarm shaving device of claim 1 wherein the head structure includes a base portion provided with first and second opposed extension portions, and the first and second non-shaving pads are respectively disposed upon and form part of the first and second extension portions.

9. The manual underarm shaving device of claim 8 wherein the first and second non-shaving skin-engaging pads are each movable relative to the first and second opposed extension portions.

10. The manual underarm shaving device of claim 9, further comprising:

first and second means for biasing, the first means for biasing applying a force tending to push the first non-shaving skin-engaging pad at least partially away from the first extension portion, and the second means for biasing applying a force tending to push the second non-shaving skin-engaging pad at least partially away from the second extension portion.

11. The manual underarm shaving device of claim 1 wherein the elongated blade structure is constructed as a detachable, replaceable cartridge structure.

12. The manual underarm shaving device of claim 11 wherein:

the head structure includes a base portion provided with first and second opposed extension portions, the first and second non-shaving pads are respectively disposed upon and form part of the first and second extension portions, and the cartridge structure is elongated and centrally located between the first and second extension portions.

13. The manual underarm shaving device of claim 1 wherein:

the first and second non-shaving pads of the head structure each have an exposed surface pre-curved along and relative to the longitudinal axis of the head structure in a concave configuration when viewed from a distance in front of the elongated front guard portion of the head structure.

14. The manual underarm shaving device of claim 13 wherein:

the first and second non-shaving pads each further pre-curved into a complex concave configuration by having a rounded front edge section, and a rounded outer edge section, and a rounded corner section which smoothly interconnects the rounded front edge section and the rounded outer edge section, with each such rounded section having an average radius of curvature of at least about 2 mm, thereby assisting in minimizing snagging and scratching of the skin surface by the non-shaving pads.

15. The manual underarm shaving device of claim 1 wherein:

the first and second non-shaving skin-engaging pads of the head structure each have an exposed surface pre-curved along and relative to the longitudinal axis of the head structure in a convex configuration when viewed from a distance in front of the elongated front guard portion.

16. The manual underarm shaving device of claim 15 wherein:

the first and second non-shaving pads each further pre-curved in a complex convex configuration by having a rounded front edge section, and a rounded outer edge section, and a rounded corner section which smoothly interconnects the rounded front edge section and the rounded outer edge section, with each such rounded section having an average radius of curvature of at least about 2 mm, thereby assisting in minimizing snagging and scratching of the skin surface by the non-shaving pads.

17. The manual underarm shaving device of claim 1 wherein at least a portion of each of the first and second non-shaving pads is elevated substantially above the working plane established by the front and rear guard portions, thereby generally helping to ensure that the skin is engaged and the skin is being deformed prior to the razor-sharp edge contacting the skin to be shaved.

18. The manual underarm shaving device of claim 17 wherein the first and second non-shaving pads (a) are each arranged as a gliding surface, and (b) are each configured to be arranged in substantial part above the working plane, and (c) each have a curved profile from front to rear of the head structure and from side to side of the head structure.

19. The razor blade shaving device according to claim 1, wherein:

the head structure includes an elongated base portion with first and second extension portions generally disposed adjacent to the first and second non-shaving pads, and the first and second non-shaving pads are operable to be resiliently biased at least in part toward the skin to be shaved and away from the extension portion adjacent thereto.

20. The manual underarm shaving device of claim 1 wherein:

the at least one razor blade is formed from a single flat straight strip of razor blade material having a razor-sharp edge along only one edge thereof, and the one razor blade, when installed in the head structure, has a flat configuration and its exposed razor-sharp edge lies along a straight line.

21. The manual underarm shaving device of claim 1 wherein:

the at least one razor blade is formed from a single flat straight strip of razor blade material having a razor-sharp edge along only one edge thereof, and the one razor blade, when installed in the head structure, is arranged in slightly curved configuration such that its exposed razor-sharp edge lies along a curved line.

22. The manual underarm shaving device of claim 1 wherein:

the head structure further includes a plurality of wire guard segments spaced from one another and each arranged to cross the elongated razor-sharp edge of the at least one razor blade such that the razor blade edge is partially shielded thereby so as to assist in preventing the razor blade edge from digging into and cutting the soft pliable skin to be shaved.

23. The manual underarm shaving device of claim 22 wherein:

the wire guard segments are formed from thin wire and are arranged in parallel sections which perpendicularly cross the exposed razor-sharp blade edge at regular intervals.

24. The manual underarm shaving device of claim 1 wherein:

the elongated razor blade structure includes at least two elongated razor blades spaced from and substantially parallel to one another, each razor blade has an elongated exposed razor-sharp edge, suitable for shaving hair, disposed between and spaced from the front and rear guard portions, which razor-sharp edge projects into the working plane defined by the guard portions, and the exposed razor-sharp edges are of substantially the same effective exposed blade edge length, and each of the razor-sharp edges has first and second exposed ends.

25. The manual underarm shaving device of claim 1 wherein the first and second non-shaving skin-engaging pads each include grip-enhancing surface formations.

26. The manual underarm shaving device of claim 25 wherein the grip-enhancing surface formations are textured and are selected from the group of textured surface formations consisting of:

(a) a plurality of dimples for assisting in the gripping or pulling the skin during shaving, and (b) a plurality of spaced elongated substantially parallel fins.

27. In a manual razor blade shaving device of the type suitable for shaving underarm skin surfaces and having a handle portion, a razor head structure for attaching to the handle portion, the razor head structure for underarm shaving comprising:

a base portion supported by the handle portion of the shaving device;

an elongated razor blade structure attached to the base portion, including elongated front and rear guard portions and at least one elongated razor blade having an elongated exposed razor-sharp edge having a blade edge profile suitable for shaving hair disposed between the front and rear guard portions, the razor blade having first and second ends, and an effective exposed blade edge length and the guard portions defining at least in part a working plane; and first and second non-shaving glide surface portions respectively located outwardly adjacent to the first and second ends of the razor blade, the first and second glide surface portions being arranged to be operable to transmit force applied to the head structure into the skin surface under the glide surface portions so as to adjust the contour of the skin surface beneath the head structure to more closely match the profile of the blade structure, whereby the razor blade edge may more safely engage the skin surface to be shaved, and wherein a ratio of the average length of the first non-shaving glide surface portion to the effective exposed blade edge length is in the range of from about 1:1 to no more than 1:3, and a ratio of the average length of the second non-shaving glide surface portion to the effective exposed blade edge length is in the range of from about 1:1 to no more than 1:3 .

28. A razor head structure for underarm shaving as in claim 27 wherein:

the length of the exposed blade edge is no more than about 25 mm long; and an overall length of each of the first and second glide surface portions, as measured along a line generally tangent to the razor-sharp blade edge and outwardly from the exposed razor-sharp blade edge, is at least about 8 mm.

29. A razor head structure for underarm shaving as in claim 27 wherein:

an overall length of each of the first and second glide surface portions, as measured along a line generally tangent to the razor-sharp blade edge and outwardly from the exposed razor-sharp blade edge, is at least about one-half of an overall length of the exposed razor-sharp blade edge.

30. A razor head structure for underarm shaving as in claim 29 wherein:

the overall length of the exposed razor-sharp blade edge is no more than about 20 mm.

31. A razor head structure for underarm shaving as in claim 27 wherein:

an overall average width of each of the first and second glide surface portions in a direction substantially perpendicular to the elongated exposed razor-sharp blade edge is at least about 8 mm.

32. A razor head structure for underarm shaving as in claim 27 wherein:

each of the first and second glide surface portions are generally curved in two substantially orthogonal directions and each has at least about 50 square mm of skin-engaging area.

33. A razor head structure for underarm shaving as in claim 27 wherein:

an overall length of each of the first and second glide surface portions, as measured along a line generally tangent to the razor-sharp blade edge and outwardly from the exposed razor-sharp blade edge, is at least about one-half of an overall length of the exposed razor-sharp blade edge.

34. A razor head structure for underarm shaving as in claim 33 wherein:

each of the first and second glide surface portions has at least about 80 square mm of skin-engaging area.

* * * * *

UNITED STATES PATENT AND TRADEMARK OFFICE

CERTIFICATE OF CORRECTION

PATENT NO. : 6,145,201
DATED : November 14, 2000
INVENTOR(S) : Edward A. Andrews It is certified that error appears in the above-identified patent and that said Letters Patent is hereby corrected as shown below:

Title page,
Item [57], ABSTRACT,
Line 3, after "structure" insert -- that --.
Line 9, after "may" insert -- be --.

Column 1,
Line 43, replace "forthe" with -- for the --.
Line 66, delete "can"

Column 2,
Line 20, delete "is".
Line 35, after "invention" insert --is --.
Line 61, after "object" insert -- is --.

Column 4,
Line 43, replace "Invention" with -- invention --.
Line 47, replace "Invention" with -- invention --.
Line 55, delete "with".
Line 56, replace "Invention" with -- invention --.

Column 5,
Line 4, replace "Invention" with -- invention --; and replace "shaved" with -- shave --.
Line 6, replace "call" with -- called --.
Line 44, after "may" insert -- be --.

Column 6,
Line 40, replace "configurations" with -- configuration --.

Column 8,
Line 27, delete "only a".

Column 9,
Line 62, after "words" insert -- , --.

UNITED STATES PATENT AND TRADEMARK OFFICE

CERTIFICATE OF CORRECTION

PATENT NO. : 6,145,201
DATED : November 14, 2000
INVENTOR(S) : Edward A. Andrews It is certified that error appears in the above-identified patent and that said Letters Patent is hereby corrected as shown below:

Column 11,
Line 30, after "above" insert -- ) --.

Column 12,
Line 52, replace "forthe" with -- for the --.
Line 57, replace "made" with -- may --.
Lines 58 and 59, replace "services" with -- surfaces --.

Column 13,
Line 21, replace "front" with -- rear --.
Line 23, replace "rear" with -- front --.

Column 14,
Line 52, replace "open" with -- opens --.
Line 59, after "side" insert -- of --.

Column 15,
Line 6, replace "forthe" with -- for the --.

Column 16,
Line 51, after "pulling" insert -- of --.
Line 63, after "may" insert -- be --.

Column 17,
Line 46, replace "has" with -- is --.
Line 54, delete "are".
Line 56, replace "768" with -- 748 --.

Column 18,
Line 53, delete "in".

Column 19,
Line 58, after "surface" insert -- of --.

UNITED STATES PATENT AND TRADEMARK OFFICE

CERTIFICATE OF CORRECTION

PATENT NO. : 6,145,201
DATED : November 14, 2000
INVENTOR(S) : Edward A. Andrews It is certified that error appears in the above-identified patent and that said Letters Patent is hereby corrected as shown below:

Column 20,
Line 14, after "look" insert -- at --.
Line 65, replace "necks" with -- nicks, --.

Column 21,
Line 14, delete "a".

Column 22,
Line 6, after "may" insert -- be --.
Line 31, replace "embodiment" with -- embodiments --.
Line 55, after "This" insert -- is --.
Line 63, after "They" insert -- are --.

Column 23, claim 2,
Line 37, replace "an" with -- a --.

Column 28, claim 33,
Line 21, replace "one-half" with -- one-third --.

Signed and Sealed this

Twelfth Day of February, 2002

*Attest:*

*Attesting Officer*

JAMES E. ROGAN
*Director of the United States Patent and Trademark Office*